US007399222B2

(12) United States Patent
Moon et al.

(10) Patent No.: US 7,399,222 B2
(45) Date of Patent: Jul. 15, 2008

(54) APPARATUS FOR OPERATING AUTO-SHUTTER IN AIR-CONDITIONER

(75) Inventors: Kwang Oh Moon, Asan (KR); Jun Woo Kim, Cheonan (KR); Jun Hyung Park, Asan (KR); Joung Hwa Bae, Asan (KR); Hyoung Bok Jung, Cheonan (KR)

(73) Assignee: Winia Mando, Inc., Asan, Chungnam (KR)

( * ) Notice: Subject to any disclaimer, the term of this patent is extended or adjusted under 35 U.S.C. 154(b) by 0 days.

(21) Appl. No.: 11/318,854

(22) Filed: Dec. 28, 2005

(65) Prior Publication Data

US 2006/0199504 A1 Sep. 7, 2006

(30) Foreign Application Priority Data

| | | |
|---|---|---|
| Dec. 31, 2004 | (KR) | 10-2004-0118411 |
| Jan. 28, 2005 | (KR) | 10-2005-0008267 |
| Jan. 28, 2005 | (KR) | 10-2005-0008269 |
| Jan. 29, 2005 | (KR) | 10-2005-0008353 |
| Jan. 29, 2005 | (KR) | 10-2005-0008354 |
| Jan. 29, 2005 | (KR) | 10-2005-0008377 |
| Jan. 29, 2005 | (KR) | 10-2005-0008389 |

(51) Int. Cl.
*F24F 7/00* (2006.01)

(52) U.S. Cl. ..... 454/277; 454/233; 454/236

(58) Field of Classification Search ..... 454/16, 454/156, 286, 154, 233, 236, 277
See application file for complete search history.

(56) References Cited

U.S. PATENT DOCUMENTS

| | | | | |
|---|---|---|---|---|
| 5,022,583 | A * | 6/1991 | Bruens | 236/49.5 |
| 5,275,219 | A * | 1/1994 | Giacomel | 160/6 |
| 5,810,661 | A * | 9/1998 | Bang | 454/286 |
| 5,816,306 | A * | 10/1998 | Giacomel | 160/6 |
| 2001/0053963 | A1 | 12/2001 | Kim et al. | |

* cited by examiner

*Primary Examiner*—Steven B. McAllister
*Assistant Examiner*—Samantha A Miller
(74) *Attorney, Agent, or Firm*—Fitzpatrick, Cella, Harper & Scinto

(57) ABSTRACT

An apparatus for operating an auto-shutter in an air-conditioner having an external casing includes a louver frame having an air exit installed in the external casing, an auto-shutter movable between an opened position opening the exit and a closed position closing the exit, and a shutter driver driving the auto-shutter. The shutter driver includes a driving motor which is rotatably mounted in the casing for tilting forwardly and backwardly, a screw-rod rotationally coupled with the driving motor, a bushing coupled with the rotational rod which ascends and descends along with the rotational rod when rotated, a slider, one end of which is coupled with the auto-shutter and the other end of which is coupled with the bushing. The frame and shutter include cooperating surfaces defining to guide the auto-shutter and cause the driving motor and the rotational rod to tilt by a predetermined angle as the auto-shutter moves from the opened position to the closed position.

14 Claims, 19 Drawing Sheets

APPARATUS FOR OPERATING AUTO-SHUTTER IN AIR-CONDITIONER

BACKGROUND OF THE INVENTION

1. Field of the Invention

The present invention relates to an apparatus for operating an auto-shutter in an air-conditioner, and more particularly, to an auto-shutter operating apparatus for use in an air-conditioner, which can open and close an auto-shutter using a shutter driver which includes a screw-rod shaped rotational rod, a bushing, a slider, and a driving motor, thereby driving the auto-shutter more effectively in terms of driving power, without employing an auto-shutter driving system which is opened and closed by a mutual operation of a conventional rack and pinion.

2. Description of the Related Art

As is well known, an air-conditioner is divided into a wall-mounted air-conditioner and a stand-alone air-conditioner according to an installation method. The air-conditioner is divided into an integral air-conditioner where an indoor device and an outdoor device are integrated, and a separated air-conditioner where an indoor device and an outdoor device are separated from each other, according to the structure of the air-conditioner.

Here, in the case of one of the separated air-conditioners, a compressor for compressing coolant at high temperature and high pressure and a condenser for condensing the compressed coolant are installed in an outdoor device, and an evaporator for heat-exchanging the condensed coolant is provided in an indoor device.

An indoor casing in the conventional separated air-conditioner includes a cabinet-shaped outer casing where predetermined components are mounted therein and a front cover forming the front surface of the outer casing.

An inhaling unit inhaling indoor air is formed in the lower area of the front cover and an exit discharging heat-exchanged air is provided in the upper area of the inhaling unit.

Also, an auto-shutter is installed in the exit, in which the auto-shutter can be moved between an opened position opening the exit and a closed position closing the exit.

In the case that the air-conditioner operates, the auto-shutter opens the exit so that heat-exchanged air can exit from the exit, while in the case that the air-conditioner does not operate, the auto-shutter closes the exit so that heat-exchanged air cannot exit from the exit.

Meanwhile, a number of technologies exist in connection with the auto-shutter driving systems. As an example, one of the auto-shutter driving systems is disclosed in Korea Laid-open Patent Publication No. 2001-111640 (Dec. 20, 2001) entitled "Apparatus for opening and closing an exit in an air ventilator." In this disclosed technology, an auto-shutter is opened and closed according to mutual operation of a rack and a pinion by a motor.

Since most of the conventional air-conditioners employ an auto-shutter driving system of a relatively complicated structure which is opened and closed by the mutual operation of a rack and a pinion, a fault ratio is relatively high and thus a maintenance cost can increase.

Accordingly, the Applicant proposed a new technique of enabling an auto-shutter to be opened and closed by a new method, thereby driving the auto-shutter more effectively in view of driving power used.

SUMMARY OF THE INVENTION

To solve the above problems of the conventional art, it is an object of the present invention to provide an auto-shutter operating apparatus for use in an air-conditioner in which an auto-shutter is opened and closed by a new system having a shutter driver which includes a screw-rod shaped rotational rod, a bushing, a slider, and a driving motor, thereby driving the auto-shutter more effectively in view of driving power used, without employing an auto-shutter driving system which is opened and closed by the rack-and-pinion mutual operation in a conventional rack and pinion structure.

It is another object of the present invention to provide an auto-shutter operating apparatus for use in an air-conditioner, which improves the auto-shutter operating apparatus in whole during implementing an shutter driver, to simultaneously reduce noise which can be generated in operation between a rotational rod and a bushing, and makes it possible to perform a smooth transfer.

It is still another object of the present invention to provide an auto-shutter operating apparatus for use in an air-conditioner, which can prevent oil from being introduced into a driving motor during operating of the auto-shutter operating apparatus.

It is yet another object of the present invention to provide an auto-shutter operating apparatus for use in an air-conditioner, which prevents vibration due to driving of a driving motor which provides a driving force for operation of an auto-shutter and enables the driving motor to be stably fixed.

It is yet still another object of the present invention to provide an auto-shutter operating apparatus for use in an air-conditioner, which accurately senses a stop position of an auto-shutter, that is, a stop position of a driving motor by a proximation sensor, at the time of ascending and descending of the auto-shutter, to thus make the driving motor stop and relatively reduce magnitudes of the sensing components, in the operating process of the auto-shutter which opens and closes an exit of the air-conditioner.

To accomplish the above object of the present invention, there is provided an auto-shutter operating apparatus for use in an air-conditioner, the auto-shutter operating apparatus comprising: an external casing in which a louver frame having an exit is installed in the inner portion of the upper end thereof; an auto-shutter movable between an opened position opening the exit and a closed position closing the exit; and a shutter driver driving the auto-shutter, wherein the shutter driver comprises: a driving motor which is rotatable forwardly and backwardly; a screw-rod shaped rotational rod which is coupled with the driving motor and thus rotates; a bushing which is coupled with the rotational rod and ascends and descends along with the rotational rod; a slider one end of which is coupled with the auto-shutter and the other end of which is coupled with the bushing; an angular rotating unit which makes the driving motor and the rotational rod rotate by a predetermined angle when the auto-shutter moves from the opened position to the closed position; and a rotational rod guider which guides and supports rotation of the rotational rod, wherein guide rails are formed on both side surfaces in the louver frame in order to guide the auto-shutter.

There is also provided an auto-shutter operating apparatus for use in an air-conditioner, the auto-shutter operating apparatus comprising: an external casing in which a louver frame having an exit is installed in the inner portion of the upper end thereof; an auto-shutter movable between an opened position opening the exit and a closed position closing the exit; and a shutter driver driving the auto-shutter, wherein the shutter driver comprises: a driving motor which is provided to provide a driving force for opening and closing and moving the auto-shutter and is rotatable forwardly and backwardly; a screw-rod shaped rotational rod which is coupled with the driving motor and thus rotates; a bushing which is coupled with the rotational rod and ascends and descends along with the rotational rod; and a slider one end of which is coupled with the auto-shutter and the other end of which is coupled with the bushing, wherein guide rails are formed on both side walls in the louver frame in order to guide the auto-shutter.

BRIEF DESCRIPTION OF THE DRAWINGS

The above objects and other advantages of the present invention will become more apparent by describing the preferred embodiment thereof in more detail with reference to the accompanying drawings in which.

DETAILED DESCRIPTION OF THE INVENTION

An auto-shutter operating apparatus for use in an air-conditioner according to a variety of preferred embodiments of the present invention will be described with reference to the accompanying drawings, respectively.

Figure 1:
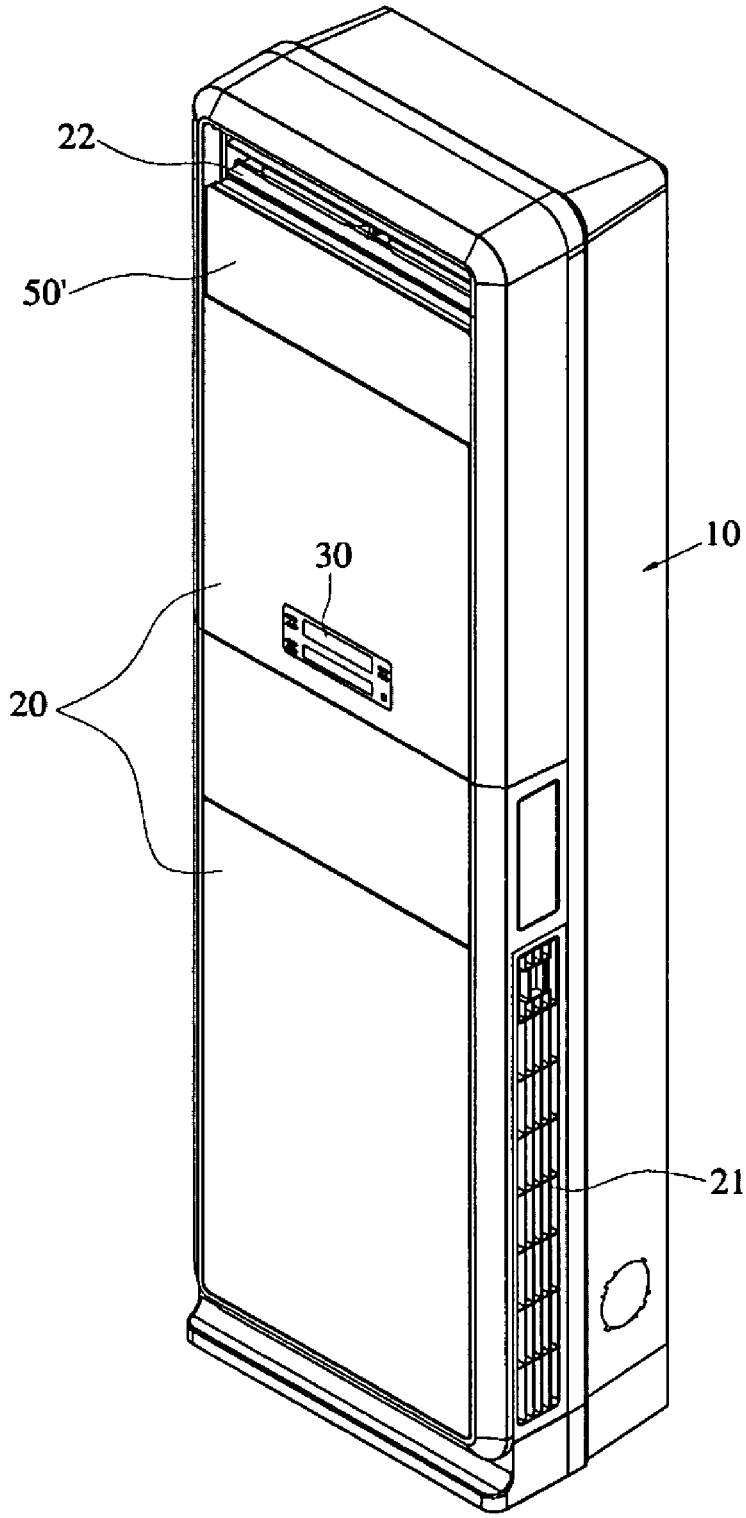
FIG. 1 is a perspective view showing an air-conditioner mounted with an auto-shutter according to the present invention.
Figure 2:
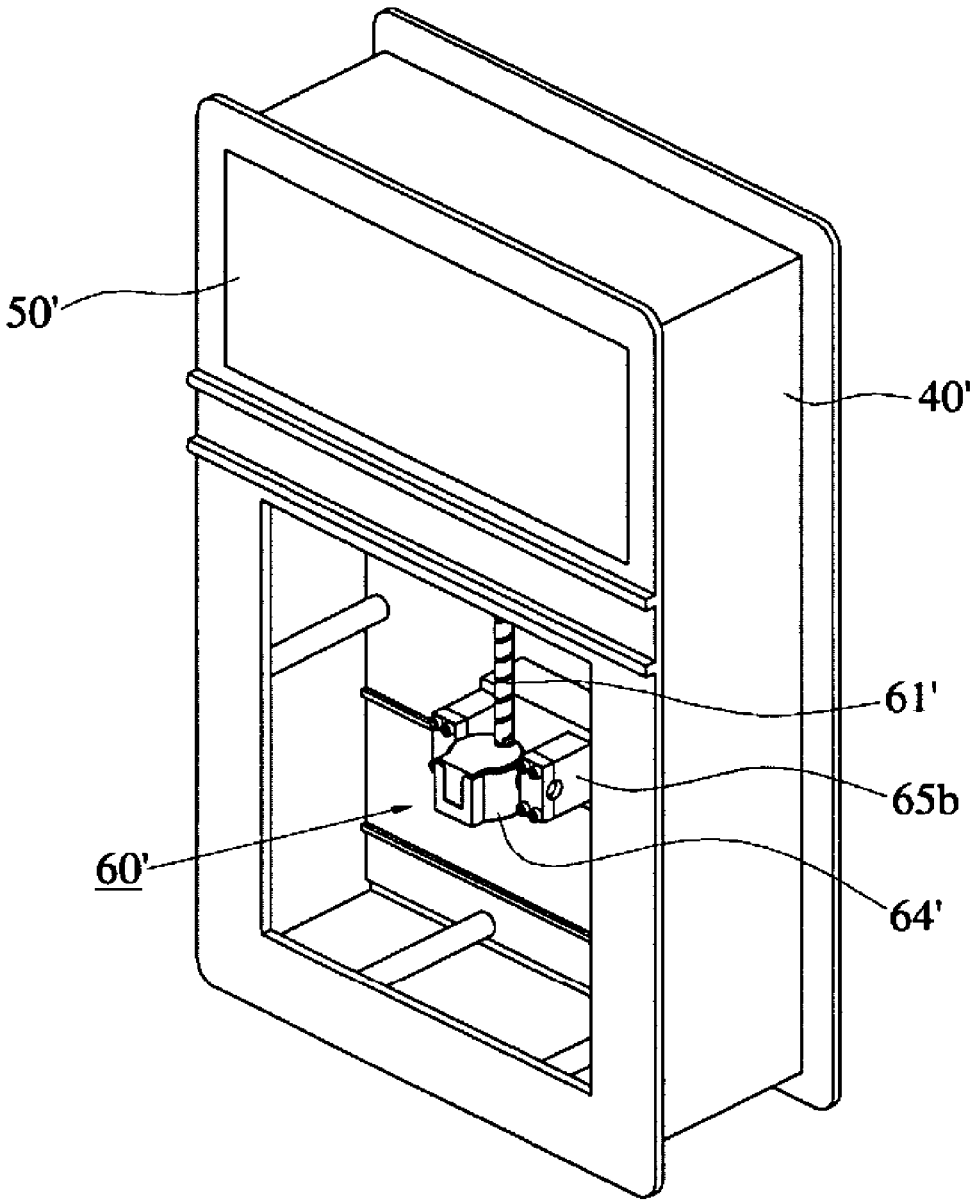
FIG. 2 is a perspective view showing only a louver frame which is an auto-shutter mount portion where an auto-shutter is mounted in an air-conditioner according to a first embodiment of the present invention.
Figure 3:
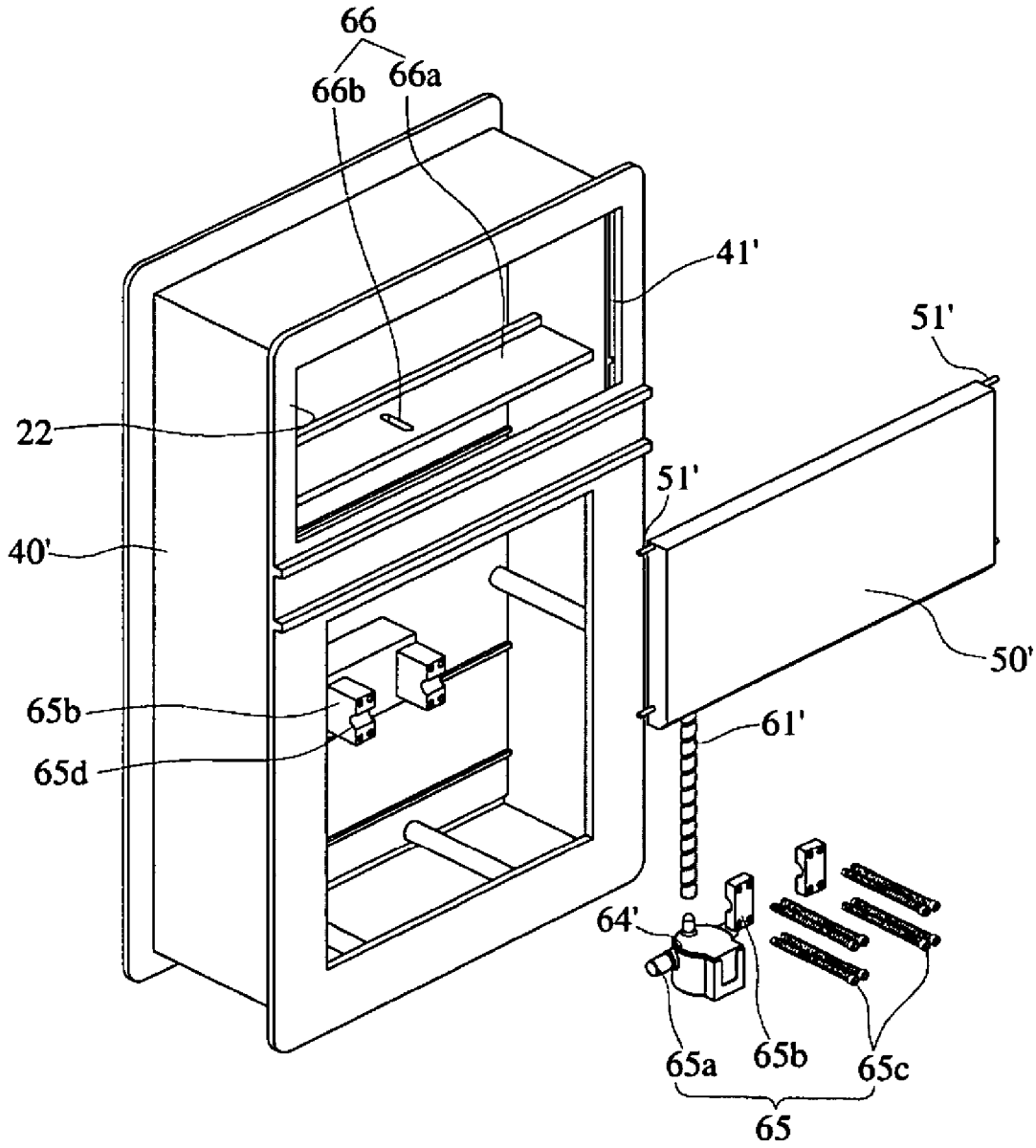
FIGS. 3 and 4 are exploded perspective views showing auto-shutter mount portions in the air-conditioner shown in FIG. 2, viewed at respectively different angles.
Figure 4:
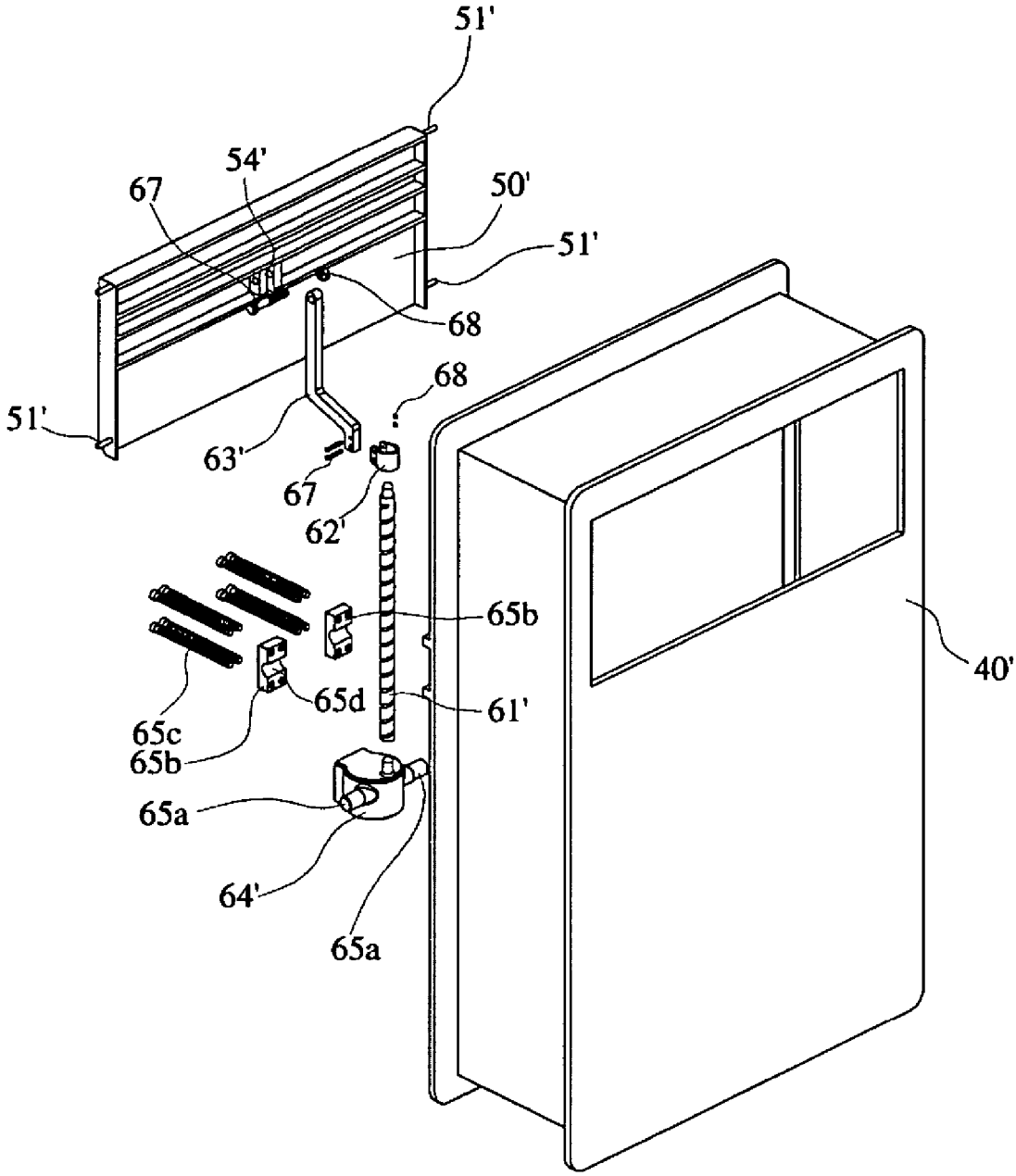
Figure 5:
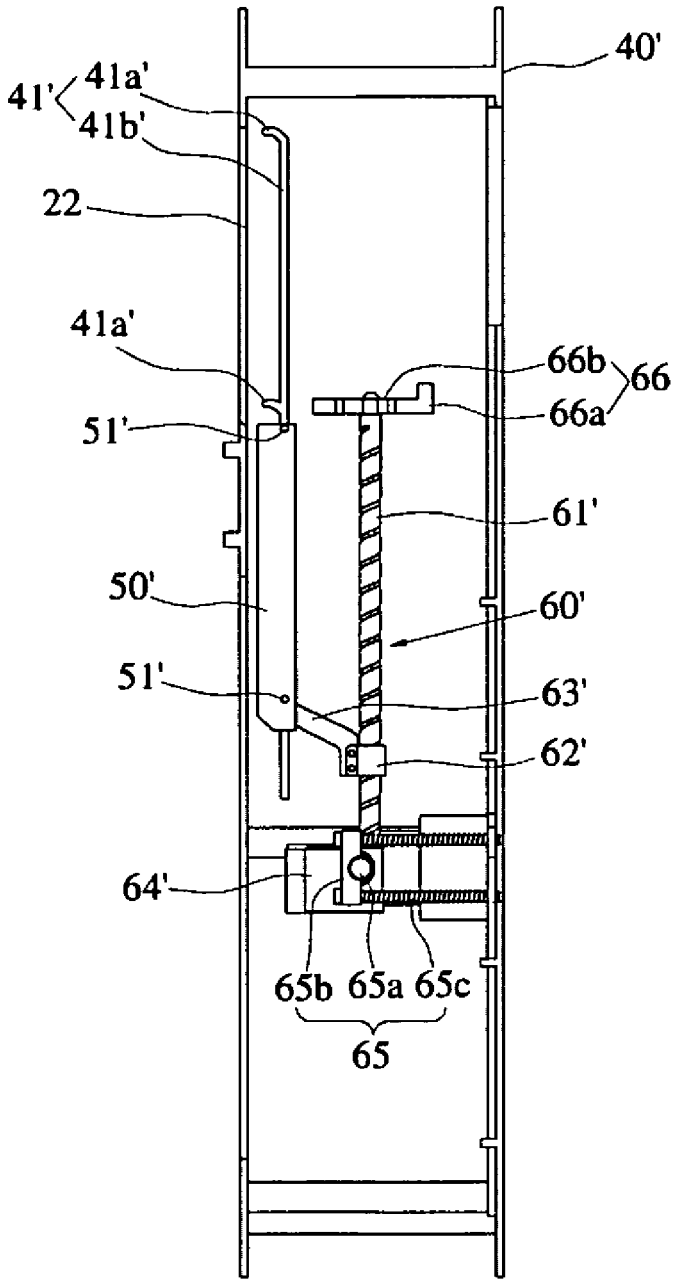
FIGS. 5 and 6 are side elevational views showing an operating state of the auto-shutter in the air-conditioner shown in FIG. 2, respectively.
Figure 6:
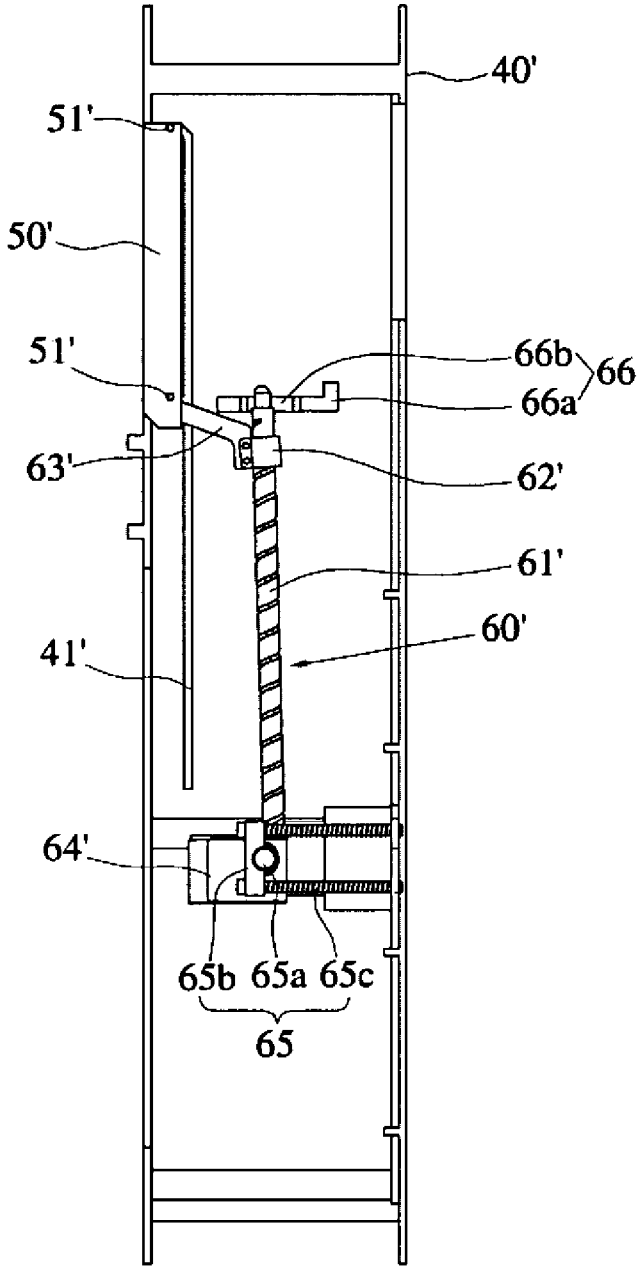

FIG. 1 is a perspective view showing an air-conditioner mounted with an auto-shutter according to the present invention. FIG. 2 is a perspective view showing only a louver frame which is an auto-shutter mount portion where an auto-shutter is mounted in an air-conditioner according to a first embodiment of the present invention. FIGS. 3 and 4 are exploded perspective views showing auto-shutter mount portions in the air-conditioner shown in FIG. 2, viewed at respectively different angles. FIGS. 5 and 6 are side elevational views showing an operating state of the auto-shutter in the air-conditioner shown in FIG. 2, respectively.

Referring to FIG. 1, an air-conditioner according to a preferred embodiment of the present invention, includes an external casing 10 in which predetermined device components are mounted and whose front surface is opened, and a front cover 20 which is coupled with the front surface of the external casing 10 and forms the front surface of the air-conditioner.

Here, an inhale unit 21 which inhales indoor air into the external casing 10 is formed at the lateral lower portion of the external casing 10. Also, an exit 22 which discharges cool air which becomes cool after being heat exchanged by a heat exchanger (not shown) is formed at the upper portion of the front cover 20.

An auto-shutter 50' which selectively opens and closes the exit 22 at the time of operating and stopping the air-conditioner is installed so as to be movably up and down in front of the exit 22.

A manipulation panel 30 which manipulates operating and stopping of the air conditioner, strength of heat exchanged air, an air blowing direction, and operation of the auto-shutter 50', is installed between the inhale unit 21 and the exit 22. Thus, a series of controls such as operations of the air-conditioner relating to an air cooling process can be performed through buttons provided in the manipulation panel 30, or a remote controller (not shown).

Also, an air blower (not shown) which guides indoor warm air inhaled into the external casing 10 via the inhale unit 21 upwards is provided in the external casing 10.

Here, a heat exchanger (not shown) which contacts air which is upwardly floated by the air blower (not shown) and heat-exchanges with respect to the contacted air is provided in one side of the inner portion of the external casing 10.

In the air-conditioner having the above-described structure, FIGS. 2 to 6 schematically show only an air-conditioner louver frame 40' in which an auto-shutter is mounted according to a first embodiment of the present invention. That is, FIGS. 2 to 6 show an auto-shutter operating apparatus according to a first embodiment of the present invention, at the state where horizontal blades and vertical blades which are provided in the area of the exit 22 and adjust direction of heat exchanged air have been omitted.

In other words, FIGS. 2 to 6 show an installation state of an auto-shutter 50' which is movable between an opened position (see FIG. 5) opening the exit 22 and a closed position (see FIG. 6) closing the exit 22, and a shutter driver 60' driving the auto-shutter 50'.

As shown in FIGS. 2 to 6, the auto-shutter 50' is driven by the shutter driver 60'.

Here, a plurality of protrusions 51' which are extended outwards and radially are formed on both side surfaces of the auto-shutter 50' so that the auto-shutter 50' can be easily moved between an opened position (see FIG. 5) opening the exit 22 and a closed position (see FIG. 6) closing the exit 22 by the shutter driver 60'. Guide rails 41' which accommodate and guide the protrusions 51' are formed on both side surfaces of the louver frame 40'.

Here, each guide rail 41' includes a vertical section 41*b*' and horizontal sections 41*a*' which are horizontally extended from certain portions of the vertical section 41*b*'. The horizontal section 41*a*' has a predetermined curvature. In the case that the protrusions 51' are disposed in the horizontal sections 41*a*', respectively, the auto-shutter 50' is positioned in a closed position (see FIG. 6).

Meanwhile, the shutter driver 60' which drives the auto-shutter 50' includes a driving motor 64' which is rotatable forwardly and backwardly, a screw-rod shaped rotational rod 61' which is coupled with the driving motor 64' and thus rotates, a bushing 62' which is coupled with the rotational rod 61' and ascends and descends along with the rotational rod 61', a slider 63' one end of which is coupled with the auto-shutter 50' and the other end of which is coupled with the bushing 62', an angular rotating unit 65 which makes the driving motor 64' and the rotational rod 61' rotate by a predetermined angle when the auto-shutter 50' moves from the opened position (see FIG. 5) to the closed position (see FIG. 6), and a rotational rod guider 66 which guides and supports rotation of the rotational rod 61'.

Here, the driving motor 64' may be embodied with a conventional motor which is easily available in the market. Thus, a stepping motor or servo motor may be used as the driving motor 64'. That is, a motor which is rotatable forwardly and backwardly by operation of the manipulation panel 30 can be used as the driving motor 64'.

One end of the slider 63' is coupled with the auto-shutter 50' and the other end thereof is coupled with the bushing 62'. Here, the bushing 62' and the slider 63' may be integrally fabricated.

However, in order to combine one end of the slider 63' with the rear surface of the auto-shutter 50', coupling units are provided as shown in FIG. 4. That is, as a simple example of the coupling units, a pair of brackets 54' are provided in the rear surface of the auto-shutter 50' and then one end of the slider 63' is disposed in the brackets 54', and combined with bolts 67 and nuts 68. Such a coupling structure of the bolts 67 and the nuts 68 may be applied in the substantially same way between the other end of the slider 63' and the bushing 62'.

Meanwhile, in order to make the auto-shutter 50' close the exit 22, the protrusions 51' of the auto-shutter 50' should be horizontally moved by a length of each horizontal section 41*a*' of the guide rails 41'. For this purpose, in addition to the slider 63', the bushing 62', the rotational rod 61', and the driving motor 64' should be moved by a length of the horizontal section 41*a'*.

However, since the driving motor 64' is fixed to the louver frame 40' by a fixing member 65*c*, the remaining elements should be rotated by a predetermined angle around the fixed point. For this reason, an angular rotating unit 65 is needed.

The angular rotating unit 65 includes a plurality of pins 65*a* which are formed on both side surfaces of the driving motor 64', a pair of pin blocks 65*b* which arrange the pins 65*a* in the louver frame 40' having pin accommodators 65*d* which rotatably encompass a plurality of the pins 65*a*, and fixing members 65*c* which fix the pin blocks 65*b* to the louver frame 40'. Conventional bolts may be employed as the fixing members 65*c*.

Thus, in order to make the auto-shutter 50' move from the opened position (see FIG. 5) to the closed position (see FIG. 6), the protrusions 51' in the auto-shutter 50' move along the vertical section 41*b*' of each guide rail 41' and then advance into the horizontal section 41*a*' of each guide rail 41'. In this case, in order to compensate for the length of the horizontal section 41*a*', the driving motor 64' and the rotational rod 61' should be rotated. Here, when the pins 65*a* of the angular rotating unit 65 are rotated at a predetermined angle in the pin accommodator 65*d* of each fixed pin block 65*b*, the driving motor 64' and the rotational rod 61' may be rotated.

In the case that the driving motor 64' and the rotational rod 61' are rotated by a predetermined angle by the angular rotating unit 65, the driving motor 64' can be supported by the angular rotating unit 65 but the rotational rod 61' cannot be supported by the angular rotating unit 65. Thus, a rotational rod guider 66 for guiding and supporting rotation of the rotational rod 61' is further included in the auto-shutter operating apparatus according to the present invention.

The rotational rod guider 66 includes a fixing plate 66*a* which is fixed along the horizontal direction in the area of the exit 22, and an elongate hole 66*b* which is penetratively formed on the plate surface of the fixing plate 66*a* and into which the upper end of the rotational rod 61' is inserted. Here, direction of the elongate hole 66*b* is congruent with the horizontal section 41*a*' in each guide rail 41'.

When the manipulation panel 30 is manipulated in the air-conditioner having the above-described structure to stop operation of the air-conditioner (that is, the auto-shutter moves from the FIG. 5 state to the FIG. 6 state), the rotational rod 61' is rotated in one direction by the driving motor 64'.

When the rotational rod 61' rotates in one direction, the bushing 62' ascends along the rotational rod 61', and the slider 63' moves upwards. Then, the protrusions 51' in the auto-shutter 50' start to ascend along the vertical section 41*b* of each guide rail 41' and thus the auto-shutter 50' ascends.

When the protrusions 51' in the auto-shutter 50' pass through the vertical section 41*b* of each guide rail 41' by the continuous operation of the driving motor 64' toward the horizontal section 41*a*', the pins 65*a* of the angular rotating unit 65 are rotated at a predetermined angle in the pin accommodator 65*d* of each fixed pin block 65*b*, in order to compensate for the angle of the auto-shutter 50' with respect to the exit 22.

In this case, the driving motor 64' and the rotational rod 61' are integrally rotated by a predetermined angle toward the auto-shutter 50'. Here, the upper end of the rotational rod 61' is guided from the elongate hole 66*b* in the fixing plate 66*a* toward the auto-shutter 50', and thus the auto-shutter 50' can move to the closed position (see FIG. 6).

Meanwhile, when a user intends to use the air-conditioner, he or she manipulates the manipulation panel 30 again to make the driving motor 64' operate. Accordingly, the rotational rod 61' is rotated backwardly. Then, the protrusions 51' in the auto-shutter 50' start to move toward the vertical sections 41*b*' from the horizontal sections 41' in the guide rails 41', respectively.

Then, the driving motor 64' and the rotational rod 61' which have been rotated by a predetermined angle by the angular rotating unit 65 vertically move and are positioned to the original state. In this case, the upper end of the rotational rod 61' moves to the opposite side of the auto-shutter 50' at the elongate hole 66*b* in the fixing plate 66*a*.

When the protrusions 51' in the auto-shutter 50' reach the vertical sections 41*b*' in the guide rails 41', respectively, the bushing 62' and the slider 63' descend by rotation of the rotational rod 61' due to the continued operation of the driving motor 64'. Accordingly, the auto-shutter 50' can make the exit 22 opened as shown in FIG. 5.

According to the first embodiment of the present invention as described above, the auto-shutter 50' is opened and closed by a new system having a shutter driver 60 which includes the rotational rod 61', the bushing 62', the slider 63', and a driving motor, thereby driving the auto-shutter 50' more effectively in view of driving power used, without employing an auto-shutter driving system which is opened and closed by the rack-and-pinion mutual operation in a conventional rack and pinion structure.

Meanwhile, based on the auto-shutter operating apparatus for use in an air-conditioner having the above-described structure, the present invention may be embodied as various different embodiments which are further implemented and modified in various forms.

As a representative example, an auto-shutter operating apparatus according to a preferred embodiment of the present invention is shown in FIGS. 7 to 21.

Figure 7:
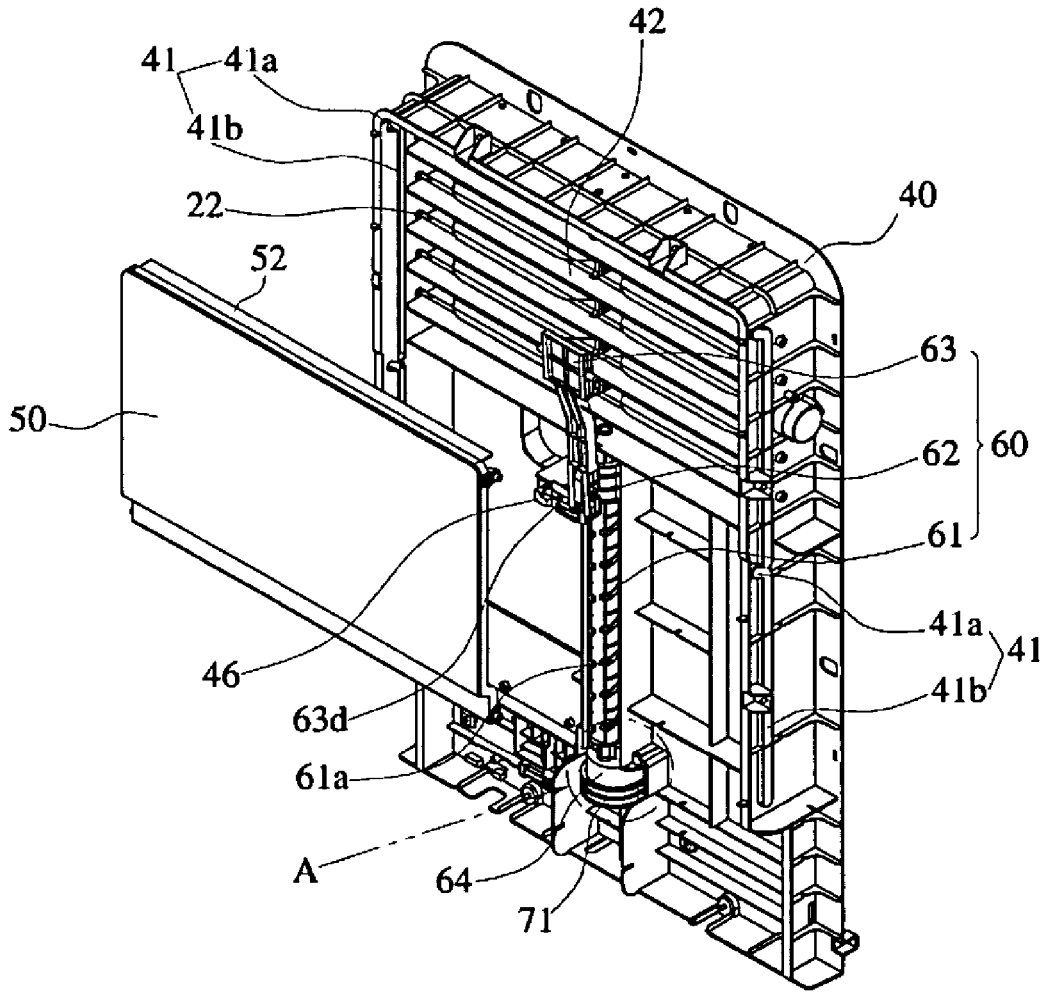
FIGS. 7 and 8 are perspective views showing a louver frame where an auto-shutter is mounted in an air-conditioner according to a second embodiment of the present invention, respectively.
Figure 8:
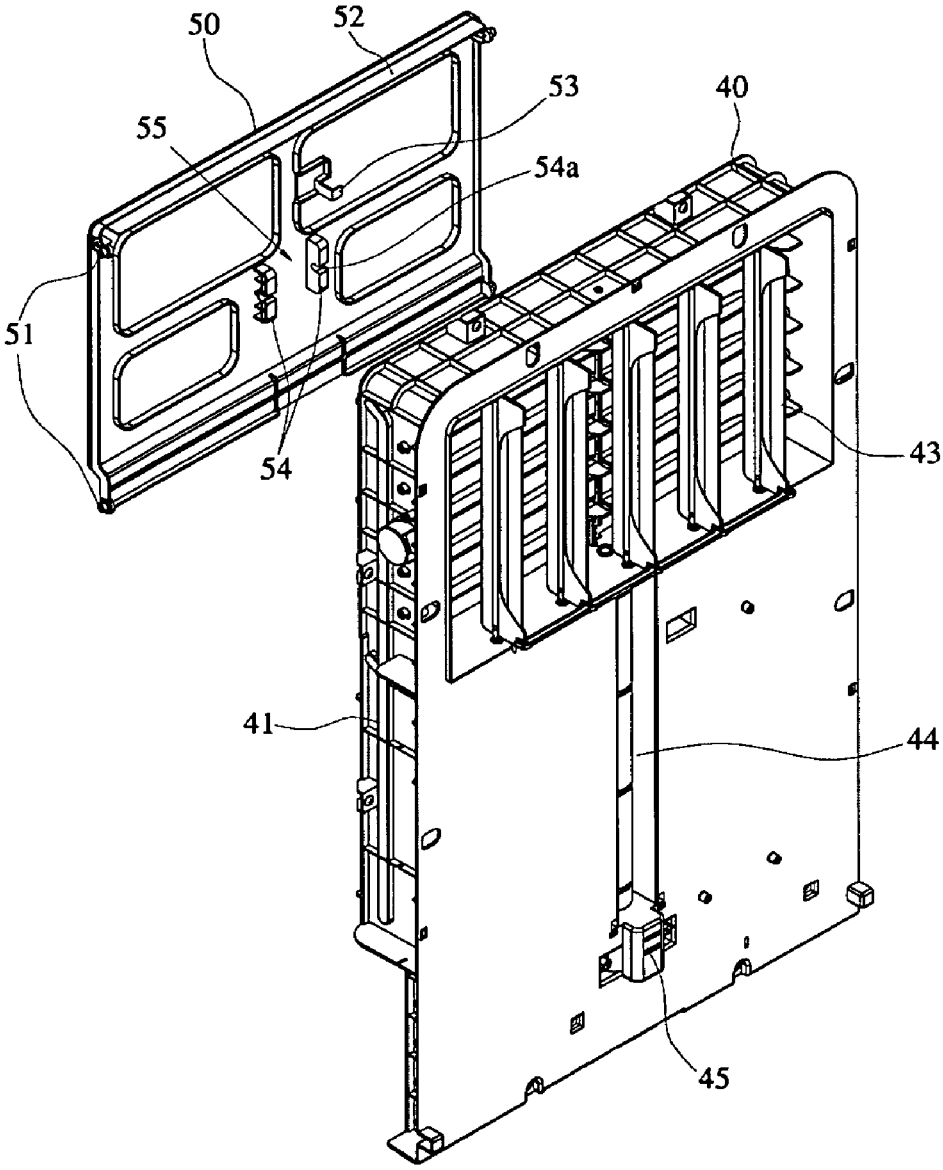
Figure 9:
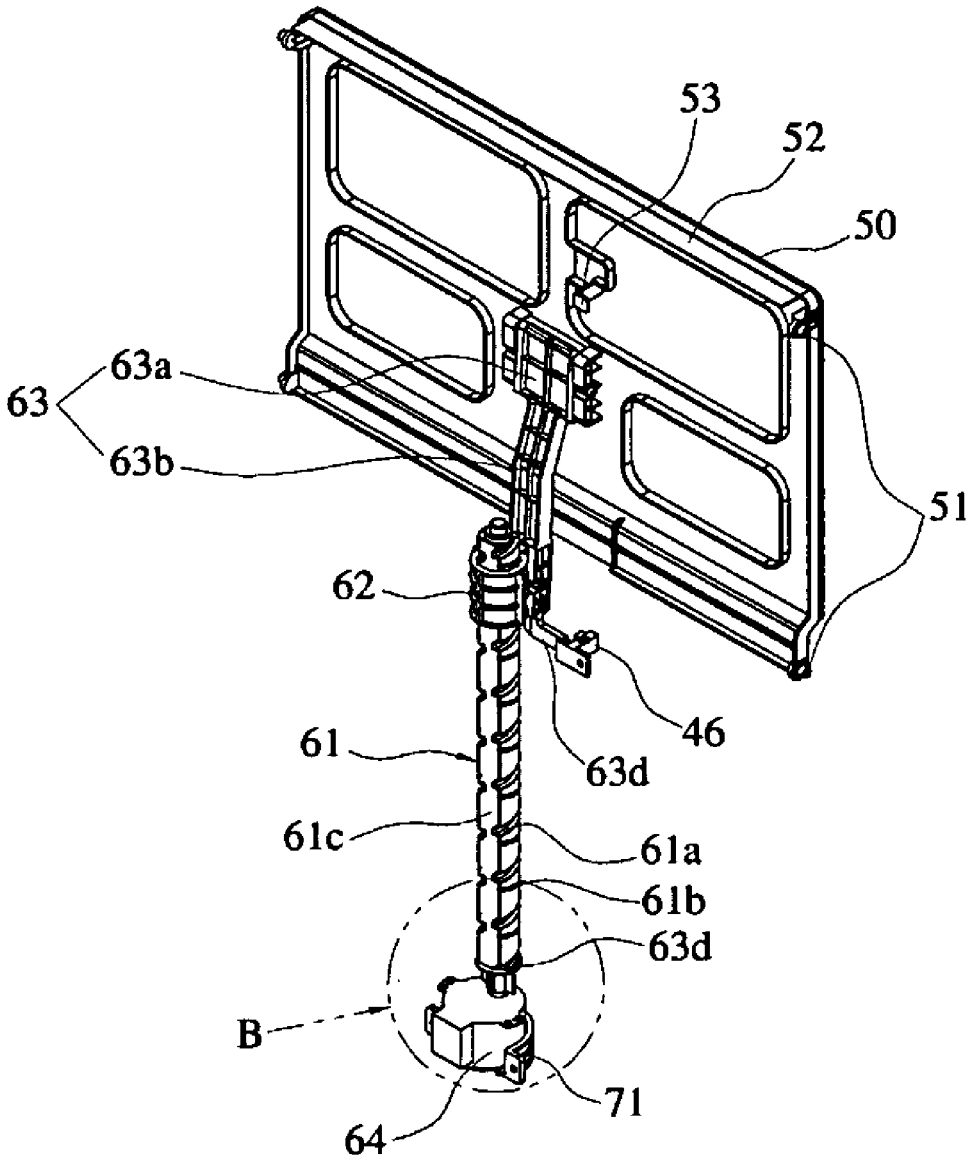
FIG. 9 is a perspective view showing only essential portions in order to show a positional relationship of the essential portions when an auto-shutter ascends in an auto-shutter operating apparatus according to the second embodiment of the present invention, to thereby close an exit.
Figure 10:
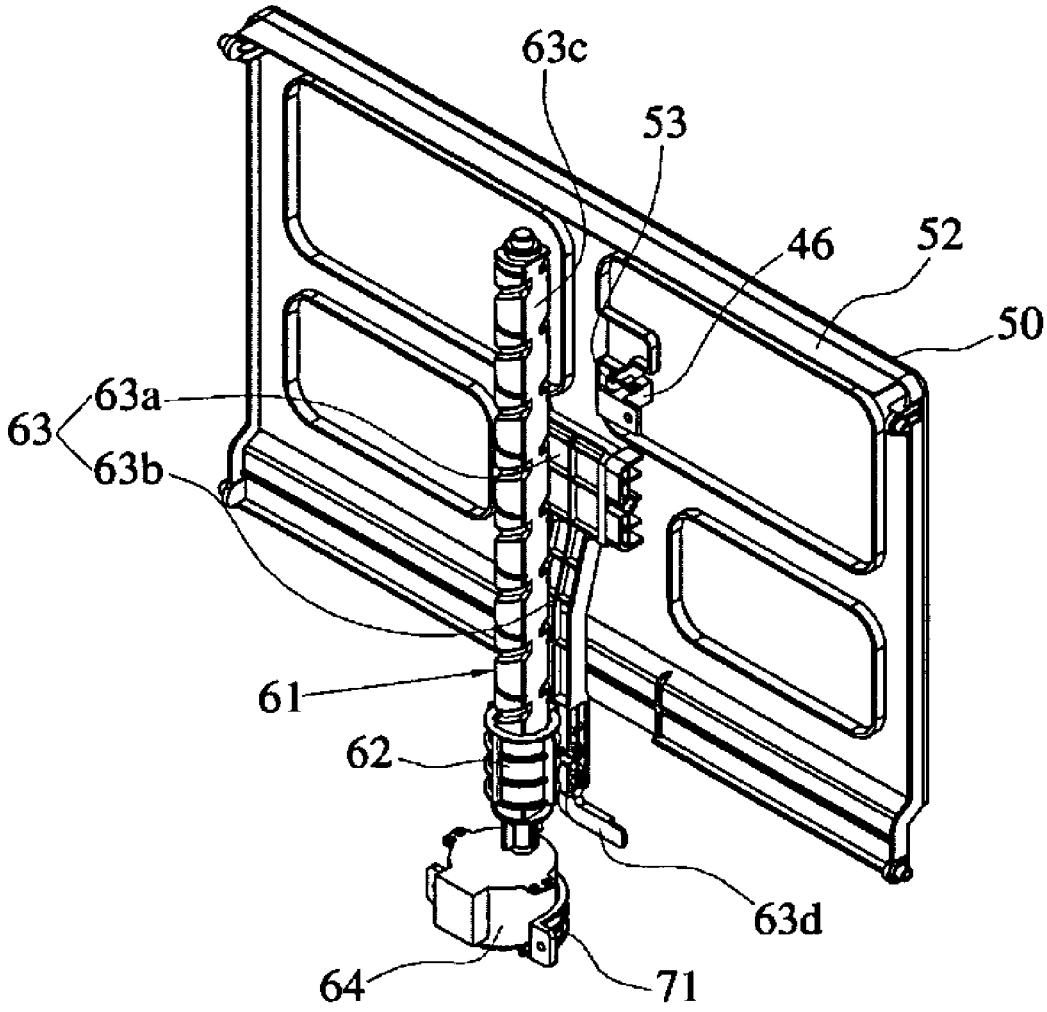
FIG. 10 is a perspective view showing only essential portions in order to show a positional relationship of the essential portions when an auto-shutter descends in the auto-shutter operating apparatus according to the second embodiment of the present invention, to thereby open the exit.
Figure 11:
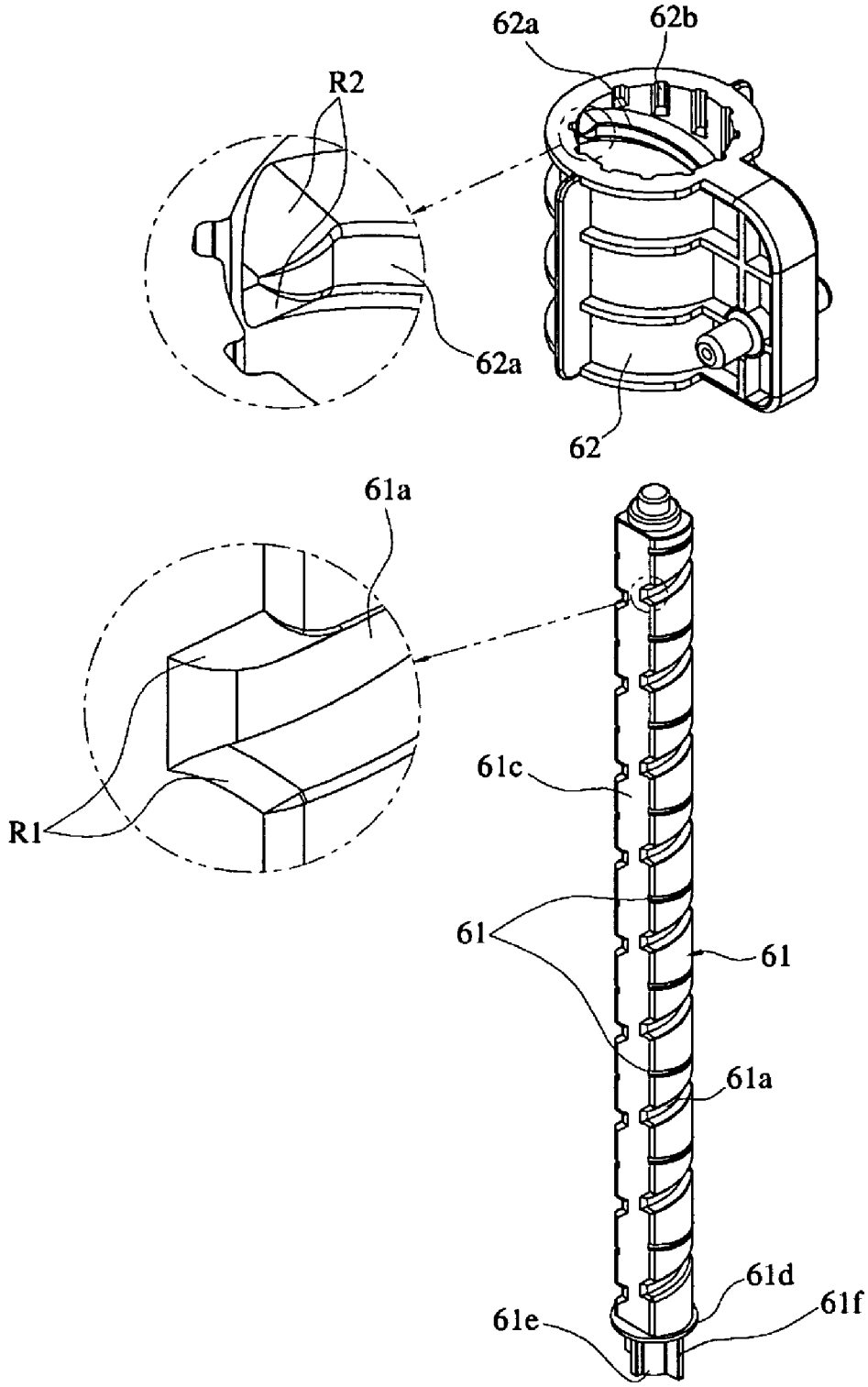
FIG. 11 is an exploded perspective view showing enlarged essential portions while showing a rotational rod and a bushing of the auto-shutter according to the second embodiment of the present invention.
Figure 12:
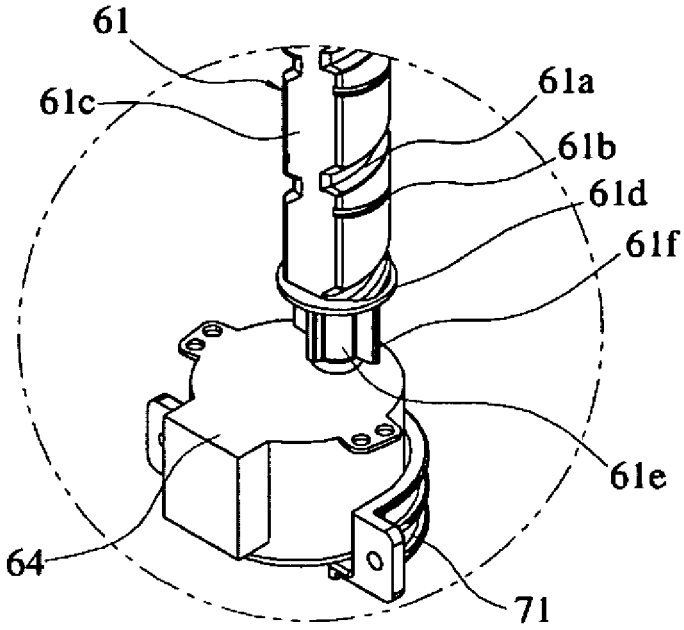
FIG. 12 is a perspective view showing an enlarged portion "B" of FIG. 9 showing a state where the rotational rod and the driving motor have been coupled with each other, according to the second embodiment of the present invention.
Figure 13:
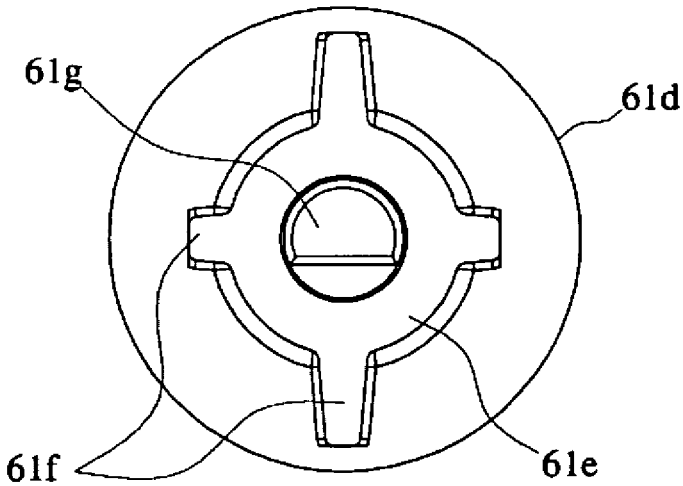
FIG. 13 is a bottom view showing a coupler of the rotational rod according to the second embodiment of the present invention.
Figure 14:
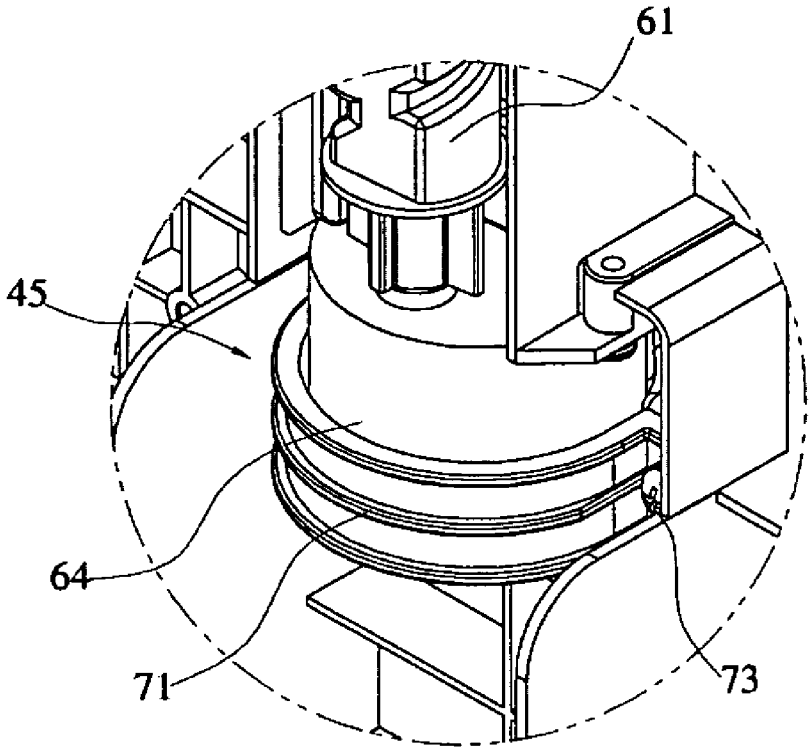
FIG. 14 is a perspective view showing an enlarged portion "A" of FIG. 7 showing a state where the driving motor has been mounted according to the second embodiment of the present invention.
Figure 15:
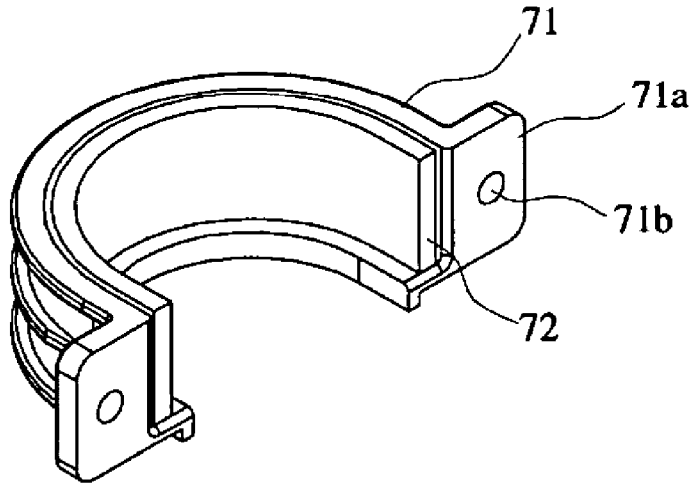
FIG. 15 is a perspective view showing a fixing cover which fixes the driving motor at a state of encompassing the driving motor, according to the second embodiment of the present invention.
Figure 16:
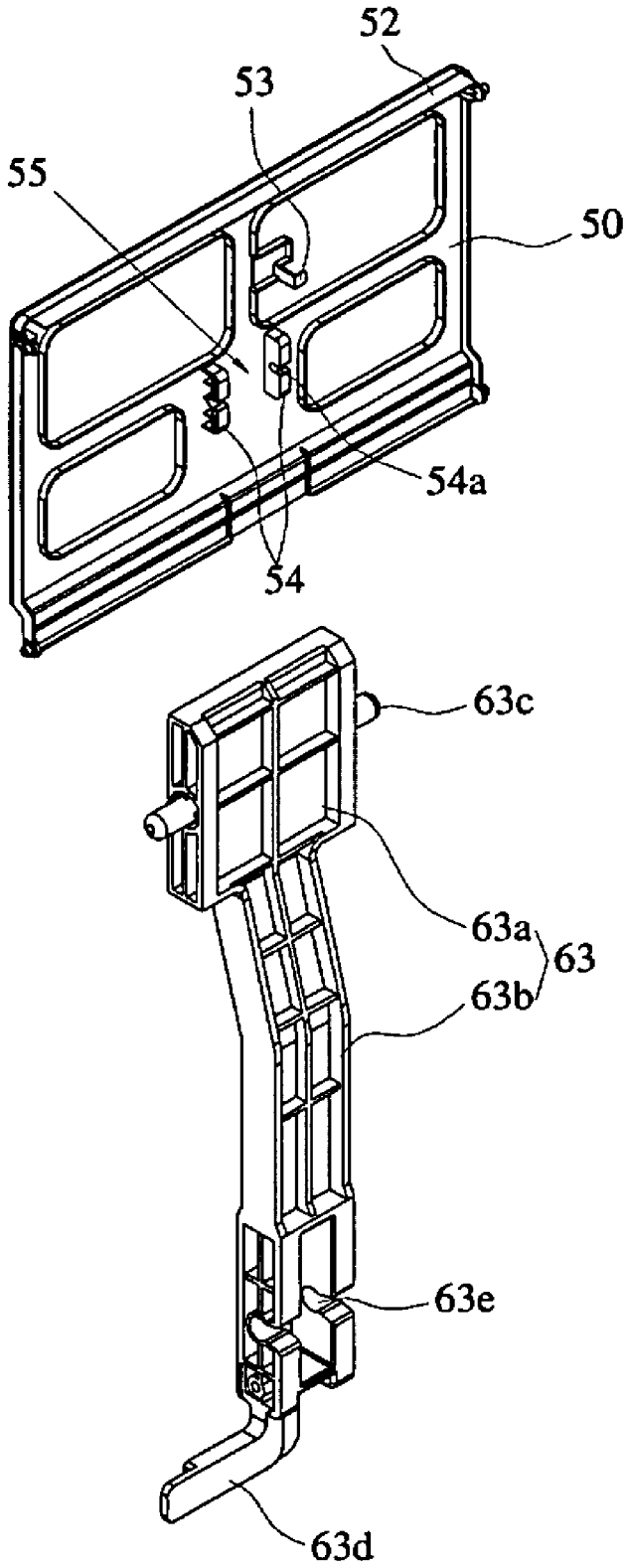
FIG. 16 is an exploded perspective view showing a state of the rear surface of the auto-shutter and a coupled state of the slider, according to the second embodiment of the present invention.

FIGS. 7 and 8 are perspective views showing a louver frame where an auto-shutter is mounted in an air-conditioner according to a second embodiment of the present invention, respectively. FIG. 9 is a perspective view showing only essential portions in order to show a positional relationship of the essential portions when an auto-shutter ascends in an auto-shutter operating apparatus according to the second embodiment of the present invention, to thereby close an exit. FIG. 10 is a perspective view showing only essential portions in order to show a positional relationship of the essential portions when an auto-shutter descends in the auto-shutter operating apparatus according to the second embodiment of the present invention, to thereby open the exit. FIG. 11 is an exploded perspective view showing enlarged essential portions while showing a rotational rod and a bushing of the auto-shutter according to the second embodiment of the present invention. FIG. 12 is a perspective view showing an enlarged portion "B" of FIG. 9 showing a state where the rotational rod and the driving motor have been coupled with each other, according to the second embodiment of the present invention. FIG. 13 is a bottom view showing a coupler of the rotational rod according to the second embodiment of the present invention. FIG. 14 is a perspective view showing an enlarged portion "A" of FIG. 7 showing a state where the driving motor has been mounted according to the second embodiment of the present invention. FIG. 15 is a perspective view showing a fixing cover which fixes the driving motor at a state of encompassing the driving motor, according to the second embodiment of the present invention. FIG. 16 is an exploded perspective view showing a state of the rear surface of the auto-shutter and a coupled state of the slider, according to the second embodiment of the present invention.

Figure 17:
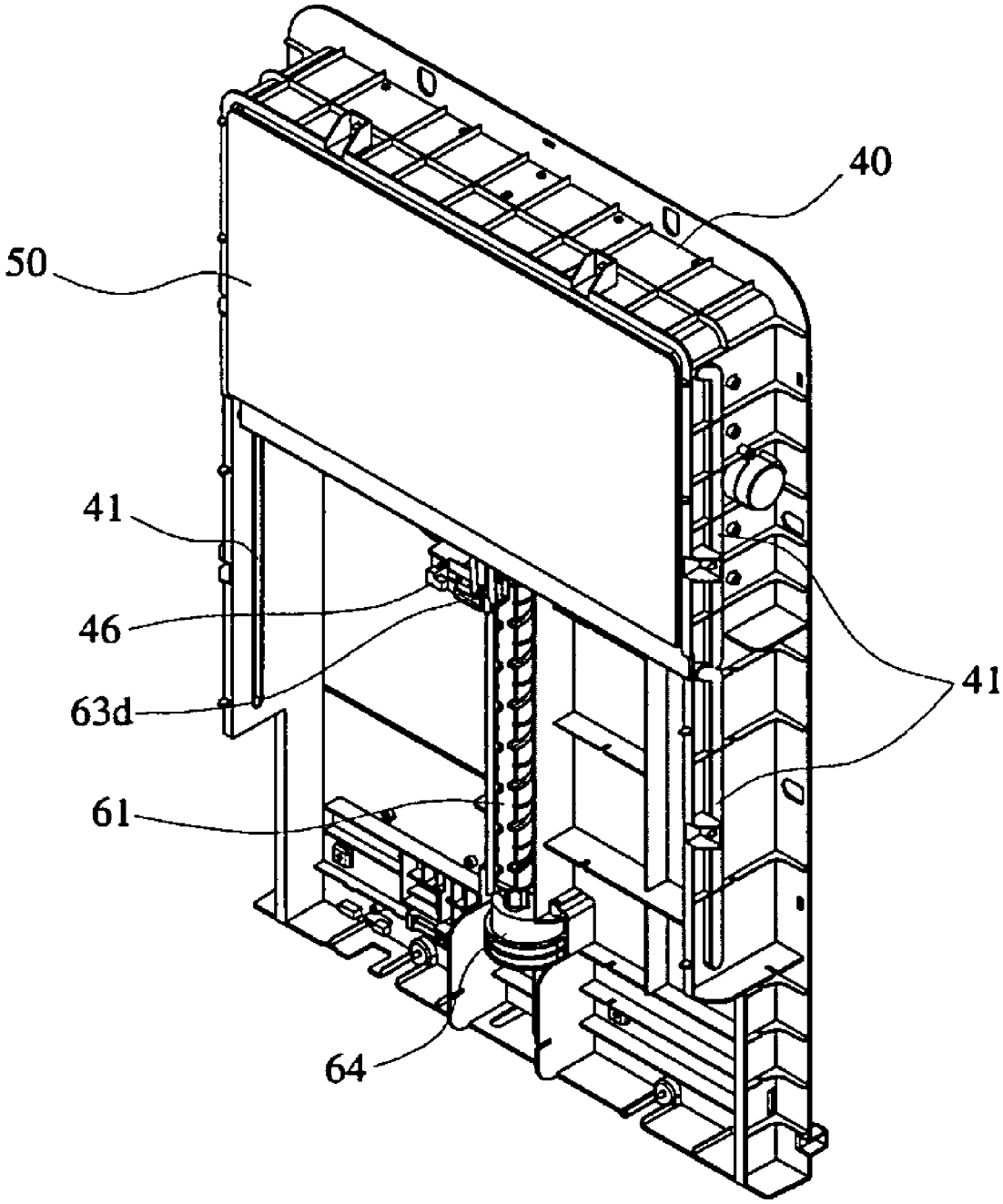
FIG. 17 is a perspective view showing a state where the exit is closed among the auto-shutter operating states, according to the second embodiment of the present invention.
Figure 18:
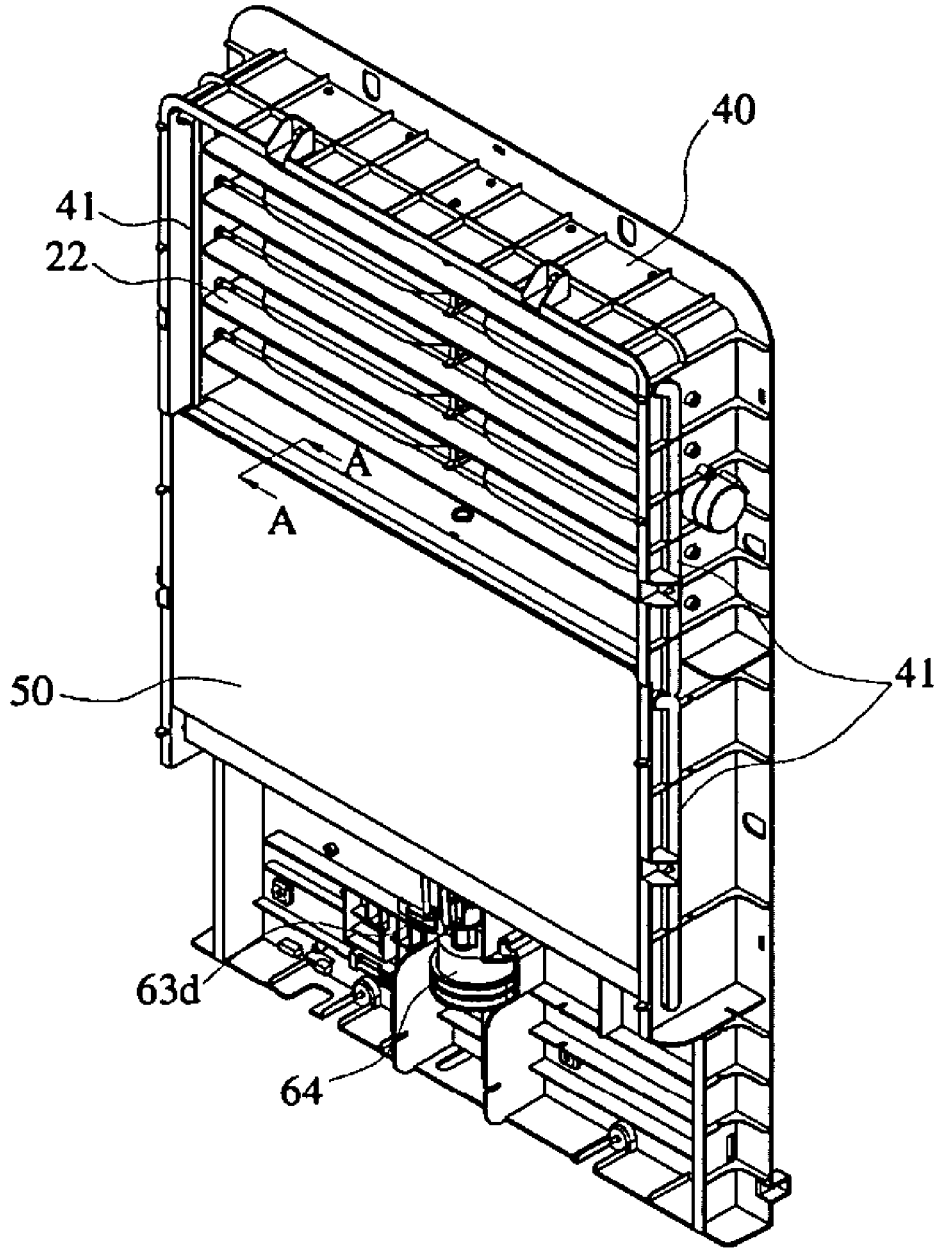
FIG. 18 is a perspective view showing a state where the exit is opened among the auto-shutter operating states, according to the second embodiment of the present invention.
Figure 19:
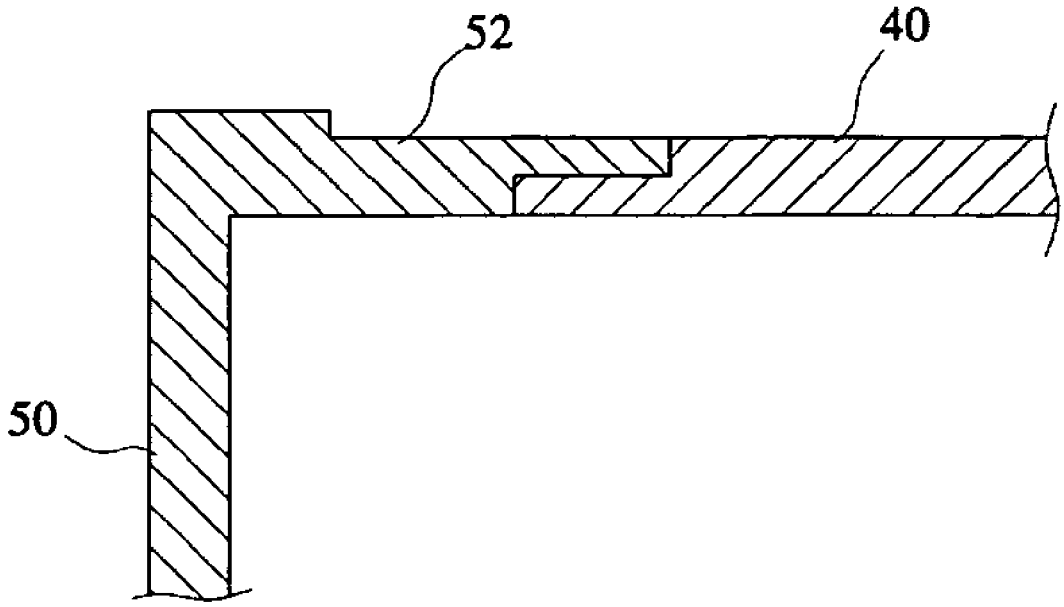
FIG. 19 is a cross-sectional view showing a state where the louver frame and the auto-shutter bent portion are engaged with each other cut along a line A-A of FIG. 18, according to the second embodiment of the present invention.

In addition, FIG. 17 is a perspective view showing a state where the exit is closed among the auto-shutter operating states, according to the second embodiment of the present invention. FIG. 18 is a perspective view showing a state where the exit is opened among the auto-shutter operating states, according to the second embodiment of the present invention. FIG. 19 is a cross-sectional view showing a state where the louver frame and the auto-shutter bent portion are engaged with each other cut along a line A-A of FIG. 18, according to the second embodiment of the present invention.

Figure 20:
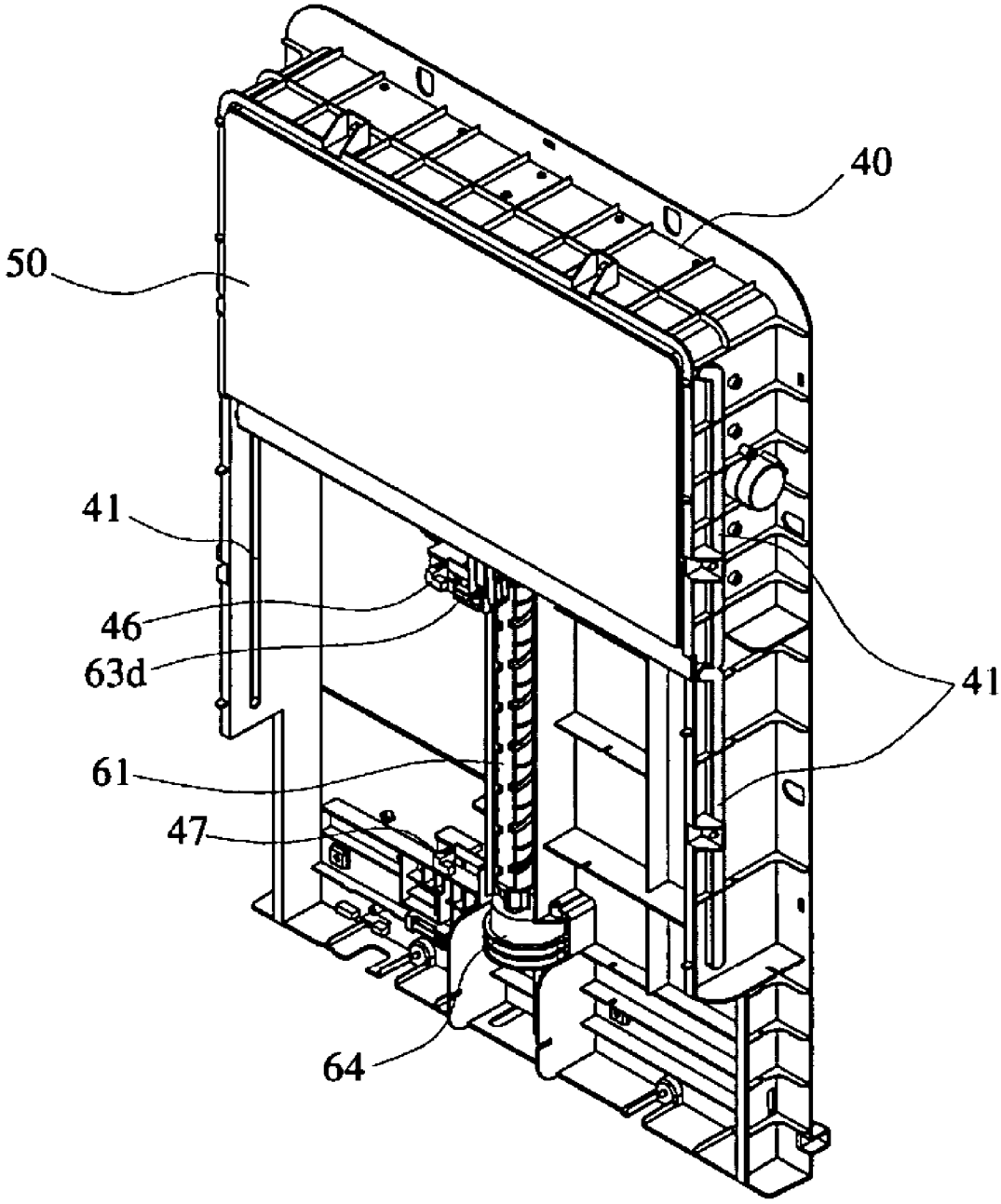
FIG. 20 is a perspective view showing a state where the exit is closed among the operating states of the auto-shutter having a plurality of detection sensors, according to the second embodiment of the present invention.
Figure 21:
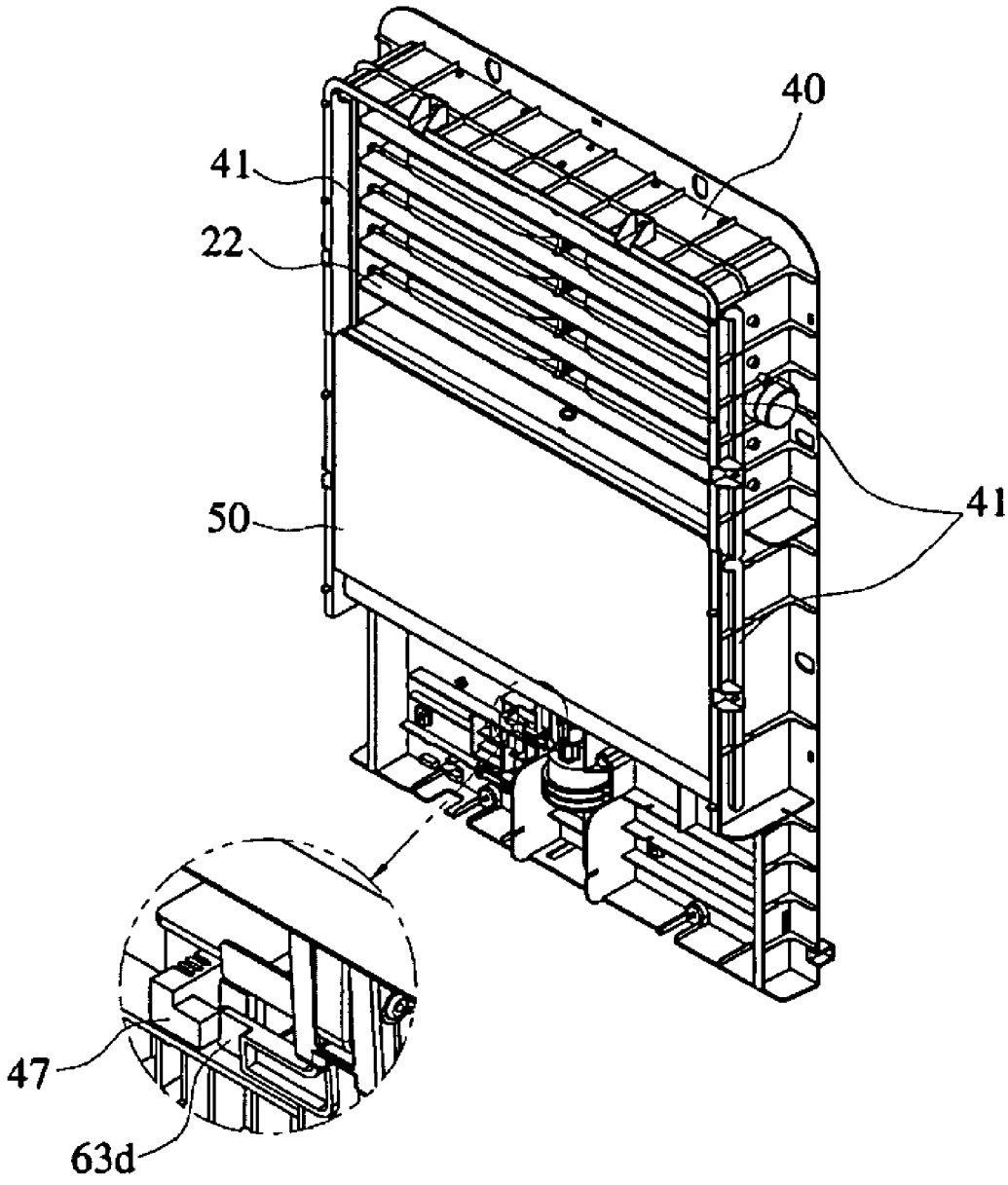
FIG. 21 is a perspective view showing a state where the exit is opened among the operating states of the auto-shutter having a plurality of detection sensors, according to the second embodiment of the present invention.

FIG. 20 is a perspective view showing a state where the exit is closed among the operating states of the auto-shutter having a plurality of detection sensors, according to the second embodiment of the present invention, and FIG. 21 is a perspective view showing a state where the exit is opened among the operating states of the auto-shutter having a plurality of detection sensors, according to the second embodiment of the present invention.

Referring to FIGS. 7 and 8, according to a second embodiment of the present invention, a louver frame 40 having an exit 22 is separately installed in the inner portion of the upper end of an external casing 10 shown in FIG. 1.

Also, horizontal blades 42 and vertical blades 43 which adjust direction of heat exchanged air are provided in the area of the exit 22.

Here, an auto-shutter 50 which is movable between an opened position (see FIG. 18) opening the exit 22 and a closed position (see FIG. 17) closing the exit 22 is in the exit 22 which is located in the front area of the horizontal blades 42 and the vertical blades 43.

The auto-shutter 50 is driven by a shutter driver 60, as in the first embodiment of the present invention.

Here, in the second embodiment of the present invention, the shutter driver 60 largely includes a rotational rod 61, a bushing 62, a slider 63, and a driving motor 64, as its constructional elements.

That is, the auto-shutter 50 performs an operation movable between an opened position (see FIG. 18) opening the exit 22 and a closed position (see FIG. 17) closing the exit 22, by mutual function of the shutter driver 60 including the rotational rod 61, the bushing 62, the slider 63, and the driving motor 64.

Hereinafter, the more detailed structure of the respective elements of the auto-shutter operating apparatus according to the second embodiment of the present invention will be described.

First, a plurality of protrusions 51 which are extended outwards are formed on both side surfaces of the auto-shutter 50. Also, guide rails 41 which accommodate and guide the protrusions 51 are formed on both side surfaces of the louver frame 40, in correspondence to the protrusions 51.

Here, each guide rail 41 includes a vertical section 41*b* and horizontal sections 41*a* which are horizontally extended from certain portions of the vertical section 41*b*.

With the structure of the guide rails 41, in the case that the protrusions 51 of the auto-shutter 50 pass the vertical sections 41*a* in the guide rails 41, and are positioned in the horizontal sections 41*a*, respectively, the auto-shutter 50 is slightly protruded to the front and is positioned in a closed position closing the exit 22 perfectly.

As shown in FIGS. 7 and 8, the upper end of the auto-shutter 50 includes a bent portion 52 which is bent inwards.

When the auto-shutter 50 descends to then open the exit 22 completely, the bent portion 52 in the auto-shutter 50 is engaged with the contact surface of the louver frame 40, to thereby perform a function of removing a gap between the auto-shutter 50 and the louver frame 40 (see FIG. 19).

Meanwhile, the shutter driver 60 which drives the auto-shutter 50 includes a screw-rod shaped rotational rod 61 which is coupled with a driving motor 64 and thus rotates, a bushing 62 which is coupled with the rotational rod 61 and ascends and descends along with the rotational rod 61, and a slider 63 one end of which is coupled with the auto-shutter 50 and the other end of which is coupled with the bushing 62.

Here, as shown in FIG. 11, the rotational rod 61 having a rod shape of a certain length and on which screw grooves are formed, is of a screw-rod shape, and is mounted on a rotational rod mount 44 provided in the louver frame 40.

That is, the rotational rod 61 has a structure of having a truncated surface 61*c* formed by truncating a circular screw-rod shaped shaft axially and symmetrically left and right. Also, the rotational rod 61 has a structure of having rounded curved surfaces R1 formed at a start point of each of screw grooves 61*a* formed at all over the rotational rod 61 excluding the truncated surface 61*c*.

On the inner circumferential surface of the bushing 62 are formed screw threads 62*a* which correspond to and are engaged with screw grooves 61*a* of the rotational rod 61, to thereby enable screwed rotation.

Also, in the screw threads 62*a* formed in correspondence to the screw grooves 61*a* of the rotational rod 61 on the inner circumferential surface of the bushing 62 which is inserted into and coupled with the rotational rod 61 are formed curved surfaces R2 corresponding to the curved surfaces R1 of the rotational rod 61.

The reasons of forming the truncated surface 61*c* and the curved surface R1 in the rotational rod 61 as well as forming the curved surface R2 in the screw threads 62*a* in the bushing 62 are to reduce noise which can be generated during operating the auto-shutter 50 as well as enable a smooth rotational transfer operation, by reducing a frictional force due to a contact between the rotational rod 61 and the bushing 62, at maximum.

That is, since the truncated surface 61*c* is formed on the rotational rod 61, a contact area with respect to the bushing 62 is greatly reduced to thus reduce a frictional force naturally. Accordingly, it is apparent to one skilled in the art that noise generated is reduced due to a decrease in friction, and a smooth transfer is performed.

Also, when the rotational rod 61 and the bushing 62 are screw-rotated through a contact structure of the curved surfaces R1 and R2, and the screw threads 62*a* of the bushing 62 pass the truncated surface 61*c* and then pass the curved portion R1 which is a start point of the screw groove 61, the curved portions R1 and R2 do not contact each other, and surface-contact naturally each other while passing the curved surface R1. As a result, a smooth rotation is performed by screwed rotation.

Meanwhile, a structure of supplying oil between the rotational rod 61 and the bushing 62 is provided so as to make it possible to perform a smoother rotational transfer by reducing rotational friction between the rotational rod 61 and the bushing 62 during operating the auto-shutter 50.

That is, a number of oil grooves 61*b* are formed in the rotational rod 61 at a certain interval separately from the screw grooves 61*a*. Also, oil grooves 62*b* are vertically formed in the inner circumferential surface of the bushing 62 at equi-intervals, separately from the screw threads 62*a* formed in correspondence to the screw grooves 61*a* of the rotational rod 61.

Thus, when the rotational rod 61 is rotated by the driving motor 64, the bushing 62 is moved up and down by the screwed rotational structure. Here, oil supplied to the oil grooves 61*b* and 62*b* play a role of lubricant during moving up and down. As a result, friction is reduced to enable a smoother transfer.

In particular, as shown in FIG. 12, the rotational shaft (not shown) of the driving motor 64 is fitted into and coupled with the lower end of the rotational rod 61. In this case, when oil is supplied through the oil grooves 61*b* and 62*b* as described above, it flows down along the rotational rod 61 and introduced into the inside of the driving motor 64 through a minute gap formed due to the rotational shaft of the driving motor 64.

In the case that oil is introduced into the driving motor 64, the driving motor 64 may be damaged. Accordingly, oil should be prevented from being introduced into the driving motor 64.

For this purpose, a shield film 61*d* is formed along the lower circumference of the rotational rod 61, in order to prevent oil from being introduced into the driving motor 64.

Thus, in the case that oil is supplied and thus flows down the lower end of the rotational rod 61, oil falls down toward the external casing of the driving motor 64 due to the shield film 61*d*. Thus, oil is not introduced into the driving motor 64 through a gap in the rotational shaft (now shown).

Referring to FIGS. 12 and 13, a coupler 61*e* whose cross-section is reduced in comparison with the body of the rotational rod 61 is formed in the lower end of the rotational rod 61, in a manner that the rotational shaft (not shown) of the driving motor 64 is fitted with and inserted into the coupler 61*e* to then be firmly fixed, and a coupling hole 61*g* with which the rotational shaft of the driving motor 64 is coupled at the center of the coupler 61*e*.

Also, the rotational rod 61 having the above-described structure has a structure of having a number of reinforced ribs 61*f* formed axially at certain intervals on the outer circumferential surface of the coupler 61*e*.

Here, four reinforced ribs 61*f* formed in the rotational rod 61 are formed on the outer circumferential surface of the coupler 61*e*, in a cross-shaped form, as a preferred embodiment of the present invention.

As described above, the reinforced ribs 61*f* are formed on the outer circumferential surface of the coupler 61*e* provided in the lower end of the rotational rod 61. Accordingly although a strong load (that is, torque) is repeatedly applied, for a long time, to the coupled portion of the rotational rod 61 from the driving motor 64, strength is structurally reinforced by the reinforced ribs 61*f*. As a result, the rotational rod 61 is prevented from being damaged.

Meanwhile, referring to FIG. 16, one end of the slider 63 is formed of a rectangular body 63*a* on the left and right sides of which hinge pins 63*c* are provided, and the other end of the slider 63 is formed of a link portion 63*b* of a shaft-shaped form in which an intermediate portion integrally extended from the rectangular body 63*a* is slightly bent so that the slider 63 is hinge-coupled with the auto-shutter 50.

As described above, the hinge pins 63*c* are protrudingly formed on both sides of the slider 63, and a slider combiner 55 of a shape of a bracket 54 is formed on the rear surface of the auto-shutter 50. As well, pin accommodation grooves 54 with which the hinge pins 63*c* of the slider 63 are elastically fitted are formed in the slider combiner 55.

That is, the slider combiner 55 formed on the rear surface of the auto-shutter 50 has a structure of the bracket 54 which is protruded left and right at certain intervals so that the slider 63 may be smoothly coupled with the auto-shutter 50. Also, the pin accommodation grooves 54*a* are formed on the bracket 54.

Here, the opening of each pin accommodation groove 54*a* is formed slightly narrower than the diameter of the hinge pins 63*c*. Accordingly, when the hinge pins 63*c* are fitted into and coupled with the slider combiner 55, the hinge pins 63*c* are not inserted into the pin accommodation grooves 54*a*, unless they are forcedly pushed from the pin accommodation groove 63*c* with a slightly strong pressure. After the hinge pins 63*c* have been combined with the pin accommodation grooves 54*a*, the openings of the pin accommodation grooves 54*a* are elastically restored in an initial state.

Thus, the hinge pins 63*c* which have been fitted with and inserted into the pin accommodation grooves 54*a* are not released from the pin accommodation grooves 54*a* unless the hinge pins 63*c* are compulsively pulled out from the pin accommodation grooves 54*a*.

Also, fitting grooves 63*e* are formed in the link portion 63*b* in order to be coupled with the bushing 62. Also, fixing protrusions (not shown) are provided on the bushing 62 in correspondence to the fitting grooves 63*e*.

In particular, although the bushing 62 and the slider 63 are separately fabricated and coupled with each other, the present invention is not limited but the bushing 62 and the slider 63 can be integrally fabricated.

According to the assembly structure of the auto-shutter 50 and the slider 63, as described above, one end of the slider 63 formed of the rectangular body 63*a* is fitted between the brackets 54 provided in the rear surface of the auto-shutter 50, and simultaneously the hinge pins 63*c* and the pin accommodation grooves 54*a* are engaged with each other, to thereby make the hinge pins 63*c* elastically fitted into and coupled with the pin accommodation grooves 54*a*.

Thus, the assembly structure of the auto-shutter 50 and the slider 63 becomes relatively very simple in comparison with the case that they have been coupled with each other using bolts 67 and nuts 68 as described in the first embodiment of the present invention. In particular, without using separate coupling units such as the bolts 67 and the nuts 68, the auto-shutter 50 and the slider 63 can be firmly fixed to thereby solve burden of the assembly process.

Also, since the auto-shutter 50 and the slider 63 are assembled in a hinge coupling structure, positional correction can be easily performed through hinge rotation in the process that the auto-shutter 50 moves along the guide rails 41.

Meanwhile, the driving motor 64 which is enlarged and shown in FIGS. 12 and 14 is an ordinarily available motor which can be rotated forwardly and backwardly, and is mounted in a driving motor mount 45 provided in the louver frame 40.

That is, the driving motor 64 is mounted in the driving motor mount 45 of the louver frame 40, and then the rotational shaft (not shown) of the driving motor 64 is fitted into and coupled with the lower end of the rotational rod 61.

Here, the second embodiment of the present invention has a fixing structure of stably fixing the driving motor 64 so that vibration due to driving of the driving motor 64 can be prevented in the process of operation of the auto-shutter 50.

Referring to FIGS. 14 and 15, the second embodiment of the present invention uses a separately fabricated fixing cover 71 when the driving motor 64 is mounted and fixed in the driving motor mount 45.

Here, the fixing cover 71 is a semi-circular component which can encompass the outer circumferential surface of the driving motor 64. A vibration absorption pad 72 is attached on the inner circumferential surface of the fixing cover 71.

Flanges 71*a* each having a screw hole 71*b* are provided on both left and right ends of the fixing cover 71. The flanges 71*a* are screw-coupled with and firmly fixed to the driving motor mount 45 through the screw holes 71*b*.

That is, since the driving motor 64 is fixed on the driving motor mount 45 in the louver frame 40 with the fixing cover 71 having the above-described structure, vibration which occurs when the driving motor 64 is driven is absorbed by the vibration absorption pad 72 on the inner circumferential surface of the fixing cover 71, to thereby suppress vibration generated. Accordingly, a problem of damage due to movement of the driving motor 64 during movement of the auto-shutter 50 can be prevented in advance.

Also, since the fixing cover 71 is firmly screw-coupled through the screw holes 71*b* of the flanges 71*a* provided on both ends of the fixing cover 71 with the outer circumferential surface of the driving motor 64 encompassed, the driving motor 64 can be more stably fixed.

Meanwhile, a stop position of the auto-shutter 50, that is, a stop point in time of the driving motor 64, according to ascending and descending of the auto-shutter 50, is controlled by a detector unit including a first proximation sensor 46 which can detect the position of the movement of the auto-shutter 50.

Here, the detector unit basically includes the first proximation sensor 46 provided in one side of the louver frame 40, a first detection bar 63*d* integrally formed in the lower end of the slider 63 coupled with the bushing 62, and a second detection bar 53 provided in the upper end of one side of the auto-shutter 50. However, the detector unit can be implemented in various forms.

In the present invention, two detection systems of the detector unit are provided.

First, as shown in FIGS. 9 and 10, and as illustrated in the operational process of the auto-shutter 50 of FIGS. 17 and 18, the first detection system is implemented including the first proximation sensor 46, and a plurality of first and second detection bars 63*d* and 53 whose positions are varied due to the up-and-down movement of the auto-shutter 50 and detected by the first proximation sensor 46.

Here, the first proximation sensor 46 is positioned at the lower end (see FIGS. 9 and 17) of the auto-shutter 50 when the auto-shutter 50 closes the exit 22 completely, and is disposed on the louver frame 40 which can be positioned in the inner side (see FIG. 10) of the auto-shutter 50 when the auto-shutter 50 opens the exit 22 completely.

In addition, the first and second detection bars 63*d* and 53 are protrudingly formed integrally on the rear surfaces of the slider 63 and the auto-shutter 50, respectively. As shown in FIGS. 9 and 17, the first detection bar 63*d* provided in the slider 63 is extended to one side of the lower end of the slider 63, that is, in the direction of contacting the first proximation sensor 46, and is detected by the first proximation sensor 46 when the auto-shutter 50 moves upwards completely to thereby close the exit 22 completely.

Here, the first detection bar 63*d* may be extended integrally to the bushing 62 not the slider 63.

Accordingly, since the lower end of the slider 63 is disposed in the same line as that of the bushing 62, the detection position is same irrespective of whether the first detection bar 63 is integrally extended to the lower end of the slider 63, or the bushing. As a result, the functional effect is not affected by the detection structure.

That is, in the case that the auto-shutter 50 ascends in order to close the exit 22, the first detection bar 63*d* provided in the bushing 62 or the slider 63 approaches and corresponds to the first proximation sensor 46. In this case, the driving motor 64 is stopped to make the auto-shutter 50 stop.

Also, as shown in FIGS. 10 and 18, the second detection bar 53 which is protrudingly formed in the rear surface of the auto-shutter 50, is provided so as to be detected by the first proximation sensor 46 in the case that the auto-shutter 50 moves downwards completely to open the exit 22 completely.

That is, in the case that the auto-shutter 50 descends in order to open the exit 22, the second detection bar 53 provided in the auto-shutter 50 approaches and corresponds to the first proximation sensor 46. In this case, the driving motor 64 is stopped to make the auto-shutter 50 stop.

Meanwhile, referring to FIGS. 20 and 21, the second detection system is implemented including first and second proximation sensors 46 and 47 which are provided at predetermined intervals in one side of the louver frame 40, and a first detection bar 63*d* which is extended integrally to the lower end of a slider 63 (see FIG. 9) coupled with the bushing 62 (see FIG. 9), or integrally to the bushing 62.

That is, the second detection system includes the two first and second proximation sensors 46 and 47, and the first detection bar 63*d* whose position is varied and detected between the first and second proximation sensors 46 and 47.

Here, as described above, when the auto-shutter 50 closes the exit 22 completely, the first proximation sensor 46 is positioned at the lower end of the auto-shutter 50, and when the auto-shutter 50 opens the exit 22 completely, the first proximation sensor 46 is disposed on the louver frame 40 which may be positioned in the inner side of the auto-shutter 50.

In addition, the second proximation sensor 47 is disposed on the louver frame 40 at a predetermined distance from the first proximation sensor 46 and at the lower end of the first proximation sensor 46.

Thus, as shown in FIG. 20, the first proximation sensor 46 plays a role of detecting the first detection bar 63*d* provided in the bushing 62 (see FIG. 9) or the slider 63 (see FIG. 9) and stopping the driving motor 64 to make the auto-shutter 50 stop in the case that the auto-shutter 50 ascends in order to close the exit 22. Also, as shown in FIG. 21, the second proximation sensor 47 plays a role of detecting the first detection bar 63*d* provided in the bushing 62 (see FIG. 10) or the slider 63 (see FIG. 10) and stopping the driving motor 64 to make the auto-shutter 50 stop in the case that the auto-shutter 50 descends in order to open the exit 22.

Hereinbelow, the operational process of the auto-shutter 50 in the air-conditioner auto-shutter operating apparatus having the above-described structure will be described with reference to the accompanying drawings.

As shown in FIGS. 9 and 10, and 17 and 18, when a user intends to use an air-conditioner at the stop state of the air-conditioner (movement from the FIG. 9 state to the FIG. 10 state, or from the FIG. 17 state to the FIG. 18 state), the auto-shutter 50 is operated to open the exit 22 which has been closed in order to prevent foreign matter from being introduced into the air-conditioner. Accordingly, the air-conditioner is in use.

For this purpose, the user manipulates the manipulation panel 30 manually or using a remote controller, to make the air-conditioner start to operate. Accordingly, the driving motor 64 is driven by a controller (not shown).

When the driving motor 64 is driven, the rotational rod 61 is rotated in one direction according to the rotational direction of the driving motor 64.

Then, the bushing 62 which has been inserted into and coupled with the rotational rod 61 descends through a screw operational function, and simultaneously the auto-shutter 50 connected with the bushing 62 and the slider 63 starts to descend.

That is, the protrusions 51 in the auto-shutter 50 which is positioned in the horizontal sections 41*a* of the guide rails 41 corresponding to the closed position of the exit 22 starts to move from the horizontal sections 41*a* to the vertical sections 41*b* in the guide rails 41, respectively.

Here, when the protrusions 51 in the auto-shutter 50 are beyond from the horizontal sections 41*a* in the guide rails 41 and approach the vertical sections 41*b*, respectively, the auto-shutter 50 is hinge-rotated at a predetermined angle by a hinge connection relationship between the auto-shutter 50 and the slider 63, to thus compensate for the moving path of the auto-shutter 50 smoothly.

Also, the protrusions 51 in the auto-shutter 50 approach the vertical sections 41*b* in the guide rails 41, respectively, the bushing 62 and the slider 63 descend according to rotation of the rotational rod 61 depending upon the continuous operation of the driving motor 64. As a result, the auto-shutter 50 can open the exit 22 into the FIG. 18 state.

Here, the point in time when the auto-shutter 50 is stopped, is determined by the process that the second detection bar 53 provided in the auto-shutter 50 is approached and detected by the first proximation sensor 46, to then make the controller (not shown) stop the driving motor 64.

As such, as shown in FIGS. 18 and 19, when the auto-shutter 50 descends completely, the bent portion 52 in the auto-shutter 50 corresponds to the contact surface of the louver frame 40 and blocks the gap with which cool air may be introduced via the exit 22 completely.

That is, when the auto-shutter 50 is completely opened, the air-conditioner operates to make the cool air discharged via the exit 22. In this case, although cool air is discharged via the exit 22, part of the cool air cannot be introduced into the air-conditioner since there is no gap between the auto-shutter 50 and the louver frame 40.

Meanwhile, a process of closing the auto-shutter 50 will be described below. When a user manipulates the manipulation panel 30 to make an air-conditioner stop (movement from the FIG. 10 state to the FIG. 9 state, or from the FIG. 18 state to the FIG. 17 state), the rotational rod 61 is rotated by driving of the driving motor 64, as described above.

Of course, in this case, the driving motor 64 is rotated inversely to that of the driving motor 64 when the auto-shutter 50 descends. Accordingly, the rotational rod 61 is rotated inversely to that of the auto-shutter 50 when the auto-shutter descends.

In this manner, when the rotational rod 61 rotates backward, the bushing 62 ascends along the rotational rod 61, to thus make the slider 63 move upwards.

Then, the protrusions 51 in the auto-shutter 50 ascend along the vertical sections 41*b* in the guide rails 41, respectively, and thus the auto-shutter 50 ascends.

The protrusions 51 in the auto-shutter 50 pass the vertical sections 41*b* and are positioned in the horizontal sections 41*a* of the guide rails 41 by the continuous operation of the driving motor 64. Accordingly, the auto-shutter 50 can move to the complete closed position of the exit 22.

Here, the point in time when the auto-shutter 50 is stopped, is determined by the process that the second detection bar 63*d* provided in the bushing 62 or the slider 63 is approached and detected by the first proximation sensor 46, to then make the controller (not shown) stop the driving motor 64.

Meanwhile, the present invention has been described with respect to the operational process of the auto-shutter 50 including the first proximation sensor 46 and the first and second detection bars 63*d* and 53. However, even in the case of the operational process of the auto-shutter 50 including the first and second proximation sensors 46 and 47 and the first detection bar 63*d*, only the detection position is different from that of the auto-shutter 50 including the first proximation sensor 46 and the first and second detection bars 63*d* and 53, and the other operational processes are same in both embodiments of the present invention. Thus, the operational process of the auto-shutter 50 including the first and second proximation sensors 46 and 47 and the first detection bar 63*d*, will be omitted.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

As described above, an auto-shutter operating apparatus for use in an air-conditioner according to the present invention provides an effect of opening and closing an auto-shutter by a new system having a shutter driver which includes a shaft such as a screw-rod shaped rotational rod, a bushing, and a slider, thereby driving the auto-shutter more effectively in view of driving power used.

Also, a predetermined curved surface is applied in screw threads and the start points of the screw threads which are formed in the rotational rod and the bushing, respectively, in the present invention, to thereby enable a smooth transfer due to a soft contact when mutual screw rotation occurs between the rotational rod and the bushing.

Also, the rotational rod is truncated to form a truncated surface. Accordingly, a contact cross-section between the rotational rod and the bushing is relatively greatly reduced to thereby reduce a frictional force naturally and thus reduce noise due to the reduction of the friction force and enable a smooth transfer.

Also, oil grooves are formed in the rotational rod and the bushing. Thus, oil is supplied through the oil grooves as lubricant. Accordingly, a frictional force is reduced between the rotational rod and the bushing to thereby enable a more smoother transfer.

Also, the present invention includes a shield film along the lower circumference of the rotational rod. Accordingly, when oil is supplied through the oil grooves, oil may be prevented from being introduced into the driving motor.

Also, a fixing cover is provided to encompass the outer circumference of the driving motor and be screw-coupled with the driving motor mount. The fixing cover includes a vibration absorption pad which can absorb vibration. Accordingly, vibration of the driving motor can be prevented and the driving motor can be stably fixed to the driving motor mount.

Also, the present invention provides an effect of easily performing correction of position during movement of the auto-shutter.

Also, reinforced ribs are formed around the lower circumference of the rotational rod. Accordingly, although torque is concentrated on the coupling portion between the rotational rod and the driving motor, damage of the rotational rod can be prevented.

Also, part of the upper end portion of the auto-shutter is bent inwards. Accordingly, a gap which may be formed between the auto-shutter and the louver frame due to mismatch between the upper end bent portion of the auto-shutter and the contact surface of the louver frame is not formed to prevent cool air to be discharged via the exit from being introduced into the air-conditioner.

In particular, even in the case that a control box provided in the lower-front portion of the louver frame is provided, cool air is not introduced. Accordingly, an erroneous operational problem of an electronic circuit due to cool air can be prevented in advance.

Also, the present invention accurately senses a stop position of an auto-shutter, that is, a stop position of a driving motor. Accordingly, the stop position of an auto-shutter, that is, the stop position of a driving motor can be accurately sensed by a proximation sensor at the time of ascending and descending of the auto-shutter, to thus make the driving motor stop. Also, the present invention relatively reduces magnitudes of the sensing components, in the operating process of the auto-shutter which opens and closes an exit of the air-conditioner, in comparison with those of the conventional mechanical components.

What is claimed is:

1. An auto-shutter operating apparatus for use in an air-conditioner having an external casing including a first side having an air exit opening therein, the auto-shutter operating apparatus comprising:

a louver frame, having an exit opening therein, mounted in said casing with the exit opening of the casing and louver frame in alignment;

an auto shutter movably mounted in said frame for movement between an opened position opening the exit opening of the louver frame and a closed position closing the exit opening of the louver frame; and shutter driving means for driving the auto-shutter between said open and closed positions, said shutter driving means comprises:

a drive motor having a housing and means for rotatably mounting said housing to allow the motor to tilt forwardly and backwardly relative to said first side;

a rotational rod having a screw thread formed along its outer surface and being coupled to said driving motor for rotation along its longitudinal axis by said motor;

a bushing coupled with said rotational rod for reciprocal movement therealong in response to the rod being rotated by said motor in either a first or second rotational direction;

a slider having a first end pivotally coupled with the auto-shutter and a second end coupled to said bushing;

a rotational rod guider mounted in said frame which guides and supports rotation of the rotational rod;

guide rails formed on opposed surfaces of said louver frame adjacent said exit opening therein; and means on said auto-shutter engaged with said guide rails for guiding movements of the auto-shutter, said guide rails having a predetermined shape defining a path of travel for the auto-shutter to cause said motor and rotational rod to tilt toward and away from said first side as said auto-shutter approaches and leaves said closed position thereof.

2. The auto-shutter operating apparatus according to claim 1, wherein said means for rotatably mounting the drive motor housing includes:

a pair of opposed pins on the surface of the driving motor housing;

a pair of pin blocks for receiving said pins; and fixing means for securing the pin blocks to the first side of said casing.

3. The auto-shutter operating apparatus according to claim 1, wherein the rotational rod guider comprises:

a fixing plate which is fixed along the horizontal direction in the area of the exit opening of the louver frame and having an elongated hole formed therein for receiving the end of the rotational rod opposite said motor to guide the rod as it is tilted.

4. The auto-shutter operating apparatus according to claim 1, wherein said means on the auto-shutter engaged with said guide rails comprises a plurality of protrusions which are extended outwards on the side surfaces of the auto-shutter into engagement with said guide rails, and said guide rails having vertical sections and horizontal guide sections which are horizontally extended from certain portions of the vertical sections, respectively, to guide the auto-shutter towards and away from the exit opening.

5. An auto-shutter operating apparatus for use in an air-conditioner having an external casing including a first side having an air exit opening therein, said auto-shutter operating apparatus comprising:

a louver frame having an exit opening formed therein mounted in the the upper end of said casing with the exit openings of the casing and louver frame in alignment;

an auto-shutter movably mounted in said frame for movement between an opened position opening the exit opening of the louver frame and a closed position closing the exit opening of the louver frame; and shutter driving means for driving the auto-shutter between said open and closed positions;

said shutter driving means comprises:

a drive motor having a housing and means for rotatably mounting said housing to allow the motor to tilt forwardly and backwardly towards and away from said first side;

a rotational rod having a screw thread formed along its surface and being coupled to the driving motor for rotation along its longitudinal axis;

a bushing coupled with said rotational rod for reciprocal movement therealong in response to the rod being rotated by said motor in either a first or a second rotational direction;

a slider having a first end pivotally coupled with the auto-shutter and a second end coupled with said bushing; and guide rail means formed on both side walls in the louver frame for guiding movement of the auto-shutter toward and away from the exit opening of said frame during operation of said motor.

6. The auto-shutter operating apparatus according to claim 5, wherein said rotational rod has a circular rod shaped shaft structure having truncated surfaces formed thereon parallel to its longitudinal axis thereby truncating the circular screw-rod shaped shaft axially and symmetrically left and right, said screw thread being formed in the overall surface of the rotational rod except for the truncated surface and having rounded curved surfaces formed at a start point of each part of the screw threads adjacent the truncated portions, and wherein said bushing has screw threads which correspond to and are engaged with the screw threads of the rotational rod, on the inner circumferential surface of the bushing, and curved surfaces corresponding to the curved surfaces of the rotational rod, in the screw threads.

7. The auto-shutter operating apparatus according to claim 6, wherein a plurality of spiral oil grooves are formed in the rotational rod at predetermined intervals separately from the screw threads, and oil grooves additionally formed in the inner circumferential surface of the bushing at equi-intervals, separately from the screw threads.

8. The auto-shutter operating apparatus according to claim 7, wherein a shield film is located along the lower circumference of the rotational rod adjacent the motor, in order to prevent oil from being introduced into the driving motor, and said driving motor being coupled at the lower side of the shield film.

9. The auto-shutter operating apparatus according to claim 8, wherein a coupler whose cross-section is reduced in comparison with the body of the rotational rod is formed at the lower end of the shield film of the rotational rod, a coupling hole with which the rotational shaft of the driving motor is coupled is formed at the center of the coupler, and a number of reinforced ribs are formed axially at certain intervals on the outer circumferential surface of the coupler.

10. The auto-shutter operating apparatus according to claim 5, wherein one end of the slider is formed as a rectangular body having left and right sides on which hinge pins are located, said slider having another end coupled with the bushing including a link portion of a shaft-shaped form integrally extended from the rectangular body, a slider combiner is formed on the rear surface of the auto-shutter, wherein the slider combiner has bracket means for smoothly coupling the slider with the auto-shutter.

11. The auto-shutter operating apparatus according to claim 10, wherein the slider is integrally formed with the bushing.

12. The auto-shutter operating apparatus according to claim 5, wherein a stop position of the auto-shutter is determined by a detector unit comprising a proximation sensor provided in one side of the louver frame, a first detection bar integrally formed in the lower end of the bushing or the slider coupled with the bushing, and a second detection bar provided in the upper end of one side of the auto-shutter.

13. The auto-shutter operating apparatus according to claim 5, wherein a stop position of the auto-shutter is determined by a detector unit comprising a plurality of proximation sensors provided in one side of the louver frame at a predetermined interval up and down, a detection bar integrally formed in the lower end of the bushing or the slider coupled with the bushing.

14. The auto-shutter operating apparatus according to claim 5, wherein an inner bent portion is formed in the upper end of the auto-shutter, to thereby make the bent portion of the auto-shutter and the contact surface of the louver frame congruent and engaged with other when the auto-shutter descends to open the exit completely.

* * * * *